US012441499B2

(12) United States Patent
Morimura et al.

(10) Patent No.: US 12,441,499 B2
(45) Date of Patent: Oct. 14, 2025

(54) BINDING MACHINE

(71) Applicant: MAX CO., LTD., Tokyo (JP)

(72) Inventors: Kouichirou Morimura, Tokyo (JP); Yusuke Yoshida, Tokyo (JP); Takahiro Ito, Tokyo (JP)

(73) Assignee: Max Co., Ltd., Tokyo (JP)

( * ) Notice: Subject to any disclaimer, the term of this patent is extended or adjusted under 35 U.S.C. 154(b) by 252 days.

(21) Appl. No.: 18/089,653

(22) Filed: Dec. 28, 2022

(65) Prior Publication Data

US 2023/0242291 A1 Aug. 3, 2023

(30) Foreign Application Priority Data

Jan. 31, 2022 (JP) ..... 2022-012593

(51) Int. Cl.
*B65B 13/28* (2006.01)

(52) U.S. Cl.
CPC ..... *B65B 13/28* (2013.01)

(58) Field of Classification Search
CPC ..... B65B 13/285; B65B 13/04; B65B 13/187; B65B 13/18; E04G 21/122; E04G 21/123; B21F 15/02; B21F 15/04
See application file for complete search history.

(56) References Cited

U.S. PATENT DOCUMENTS

| | | | | |
|---|---|---|---|---|
| 5,678,613 | A | 10/1997 | Murayama et al. | |
| 2004/0244866 | A1 | 12/2004 | Ishikawa et al. | |
| 2007/0227613 | A1 | 10/2007 | Matsuoka et al. | |
| 2011/0214579 | A1 | 9/2011 | Millett et al. | |
| 2021/0180347 | A1* | 6/2021 | Mizuno | E04G 21/123 |
| 2022/0034110 | A1* | 2/2022 | Morimura | E04G 21/123 |
| 2022/0325543 | A1* | 10/2022 | Matsuno | B65B 13/285 |

FOREIGN PATENT DOCUMENTS

| | | | |
|---|---|---|---|
| CL | 2021002015 | A1 | 1/2022 |
| JP | S63-128902 | A | 6/1988 |
| JP | H07-034110 | Y2 | 8/1995 |
| JP | H10-250703 | A | 9/1998 |
| JP | 3050516 | B2 | 6/2000 |

(Continued)

OTHER PUBLICATIONS

Partial European Search Report dated Jul. 4, 2023, issued by the European Patent Office in the corresponding European Patent Application No. 23151267.4 . (11 pages).

*Primary Examiner* — Debra M Sullivan
(74) *Attorney, Agent, or Firm* — Banner & Witcoff, Ltd.

(57) ABSTRACT

A binding machine includes: a wire feeder; a curl forming unit forming a wire feeding path for winding a wire fed in a first direction by the wire feeder; a binding unit configured to twist a wire wound around the objects to be bound; and a controller configured to control the wire feeder and the binding unit. The wire feeder includes a pair of feed members configured to clamp a wire and feed a wire by a rotation operation, and a feed motor configured to rotate in a first rotation direction to drive the feed members to feed a wire in the first direction, and the controller changes a state into a first state and a second state to feed a wire in the first direction, when a wire is inserted into a position where a wire is feedable in the first direction by the pair of feed members.

13 Claims, 17 Drawing Sheets

(56) References Cited

FOREIGN PATENT DOCUMENTS

| | | | |
|---|---|---|---|
| JP | 2003-034305 | A | 2/2003 |
| JP | 2008-291642 | A | 12/2008 |
| JP | 2017-164807 | A | 9/2017 |
| JP | 2019-070256 | A | 5/2019 |
| JP | 2022-027448 | A | 2/2022 |
| WO | 2005/124060 | A1 | 12/2005 |

* cited by examiner

BINDING MACHINE

CROSS-REFERENCE TO RELATED APPLICATIONS

This application is based on and claims priority under 35 USC 119 from Japanese Patent Application No. 2022-012593 filed on Jan. 31, 2022, the contents of which are incorporated herein by reference.

TECHNICAL FIELD

The present disclosure relates to a binding machine that binds objects to be bound such as reinforcing bars with a wire.

BACKGROUND ART

Reinforcing bars are used in concrete structures to improve the strength, and are bound with wires such that the reinforcing bars do not deviate from a predetermined position when concrete is poured.

A technique is proposed in the related art, in which a binding machine called a reinforcing bar binding machine winds a wire around two or more reinforcing bars, twists the wire wound around the reinforcing bars, and binds the two or more reinforcing bars with the wire. The binding machine includes a binding wire feeding mechanism that feeds a wire wound on a reel and winds the wire around reinforcing bars, a gripping mechanism that grips the wire wound around the reinforcing bars, and a binding wire twisting mechanism that twists the wire by rotationally driving the gripping mechanism, and a trigger operation causes the binding wire feeding mechanism, the gripping mechanism and the binding wire twisting mechanism to operate in sequence to perform one cycle of binding operation.

When reinforcing bars are bound with a wire, if the binding is loose, the reinforcing bars are deviated from one another, and therefore, it is required to firmly hold the reinforcing bars together.

Therefore, there is a proposed technique of feeding a wire wound around reinforcing bars in a backward direction and winding the wire around the reinforcing bars (see, for example, Japanese Patent Application Laid-Open Publication No. 2003-34305 (hereinafter, referred to as Patent Literature 1). In addition, there is also a proposed technique of feeding a wire by a pair of rotationally driven rollers (see, for example, Japanese Utility Patent Application Laid Open Publication No. H07-34110).

In a binding machine that clamps and feeds a wire by a pair of rollers, a technique of detecting that a wire has been inserted and automatically loading the wire is conceivable.

However, in a technique in which an operation of feeding the wire by driving a motor is started by an operation of inserting the wire between the pair of rollers by a user of the binding machine, it is difficult for the user to recognize at what timing the binding machine detects that the wire is inserted and starts the operation of feeding the wire.

The present invention is made to solve such a problem, and an object thereof is to provide a binding machine that allows a user of the binding machine to recognize that an operation of feeding the wire by driving a motor is started by an operation of inserting the wire between a pair of feed gears by the user of the binding machine.

SUMMARY

An aspect of the present disclosure relates to a biding machine including a wire feeder configured to feed a wire in a first direction; a curl forming unit forming a wire feeding path for winding, around objects to be bound, a wire fed in the first direction by the wire feeder; a binding unit configured to twist a wire wound around the objects to be bound; and a controller configured to control the wire feeder and the binding unit. The wire feeder includes a pair of feed members configured to clamp a wire and feed a wire by a rotation operation, and a feed motor configured to rotate in a first rotation direction to drive the feed members to feed a wire in the first direction, and the controller changes a state into a first state and a second state to feed a wire in the first direction, when a wire is inserted into a position where a wire is feedable in the first direction by the pair of feed members.

In the present invention, it is recognized that when the operation of feeding the wire in the first direction is performed, the wire is fed in the first direction by driving the feed motor by changing the state into the first state and the second state.

According to the present invention, the user of the binding machine can recognize that by the operation of inserting the wire between the pair of feed gears by the user of the binding machine, the wire is fed in the first direction by driving the feed motor.

DESCRIPTION OF EMBODIMENTS

An example of a reinforcing bar binding machine as an embodiment of a binding machine according to the present invention will be described below with reference to the drawings.

<Configuration Example of Reinforcing Bar Binding Machine>

Figure 1A:
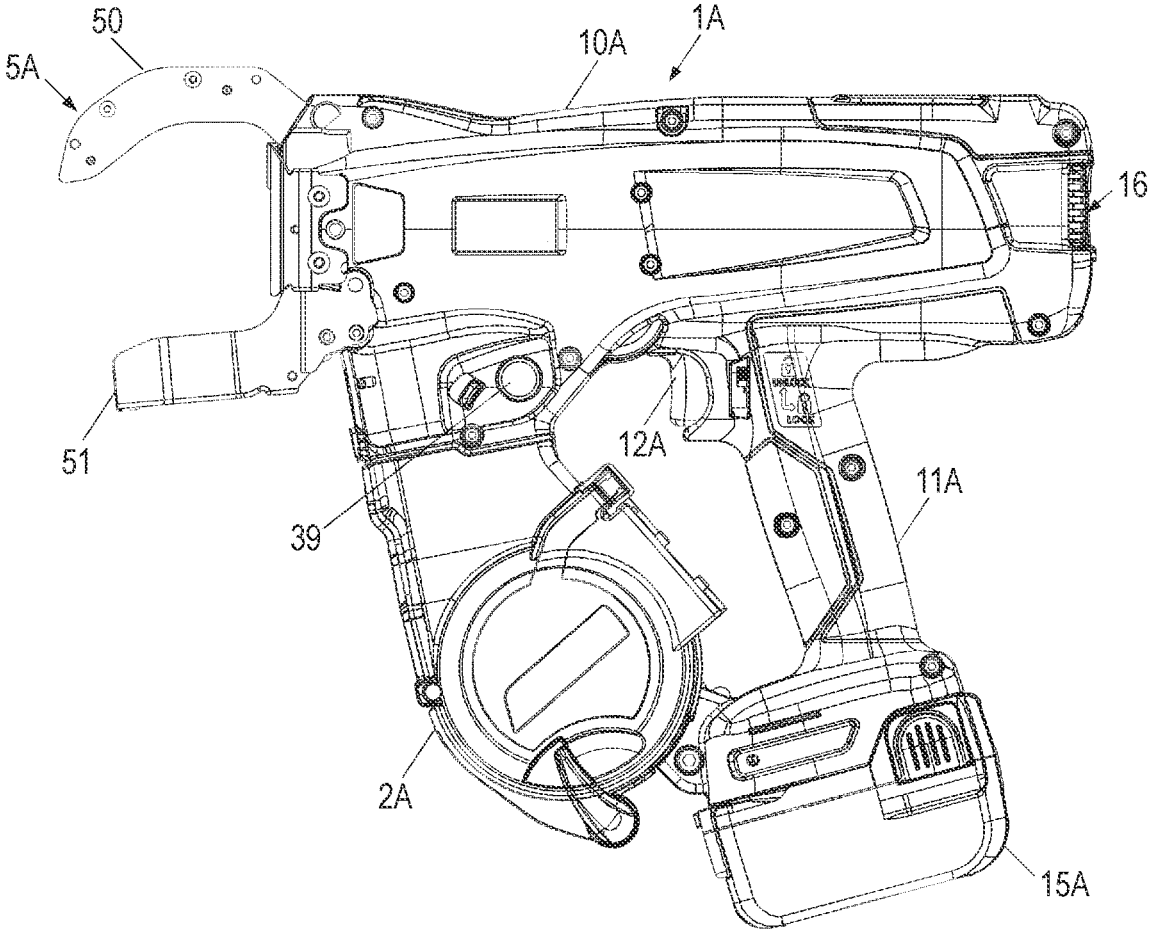
FIG. 1A is a side view showing an example of a reinforcing bar binding machine.
Figure 1B:
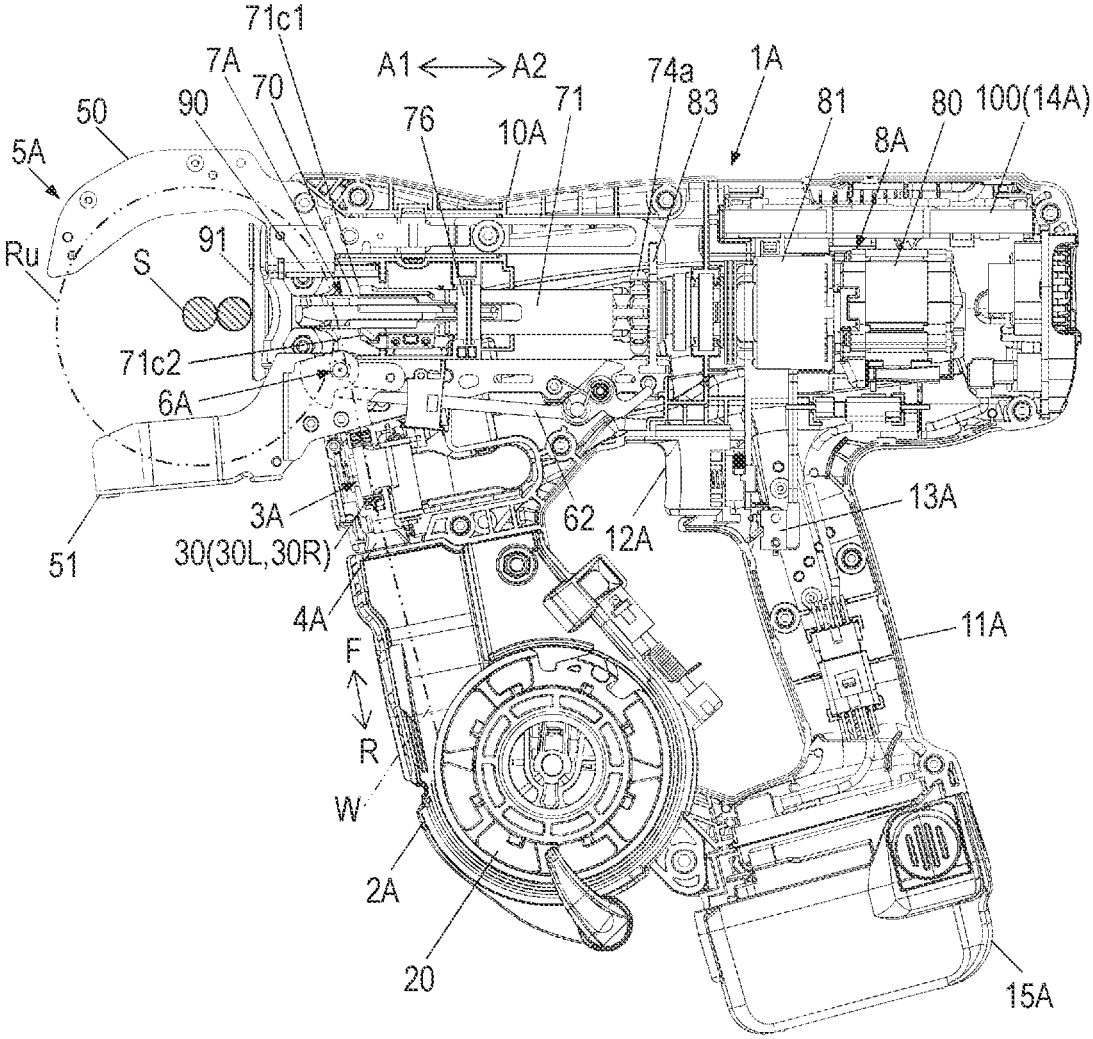
FIG. 1B is a side view showing an example of an internal configuration of the reinforcing bar binding machine.
Figure 1C:
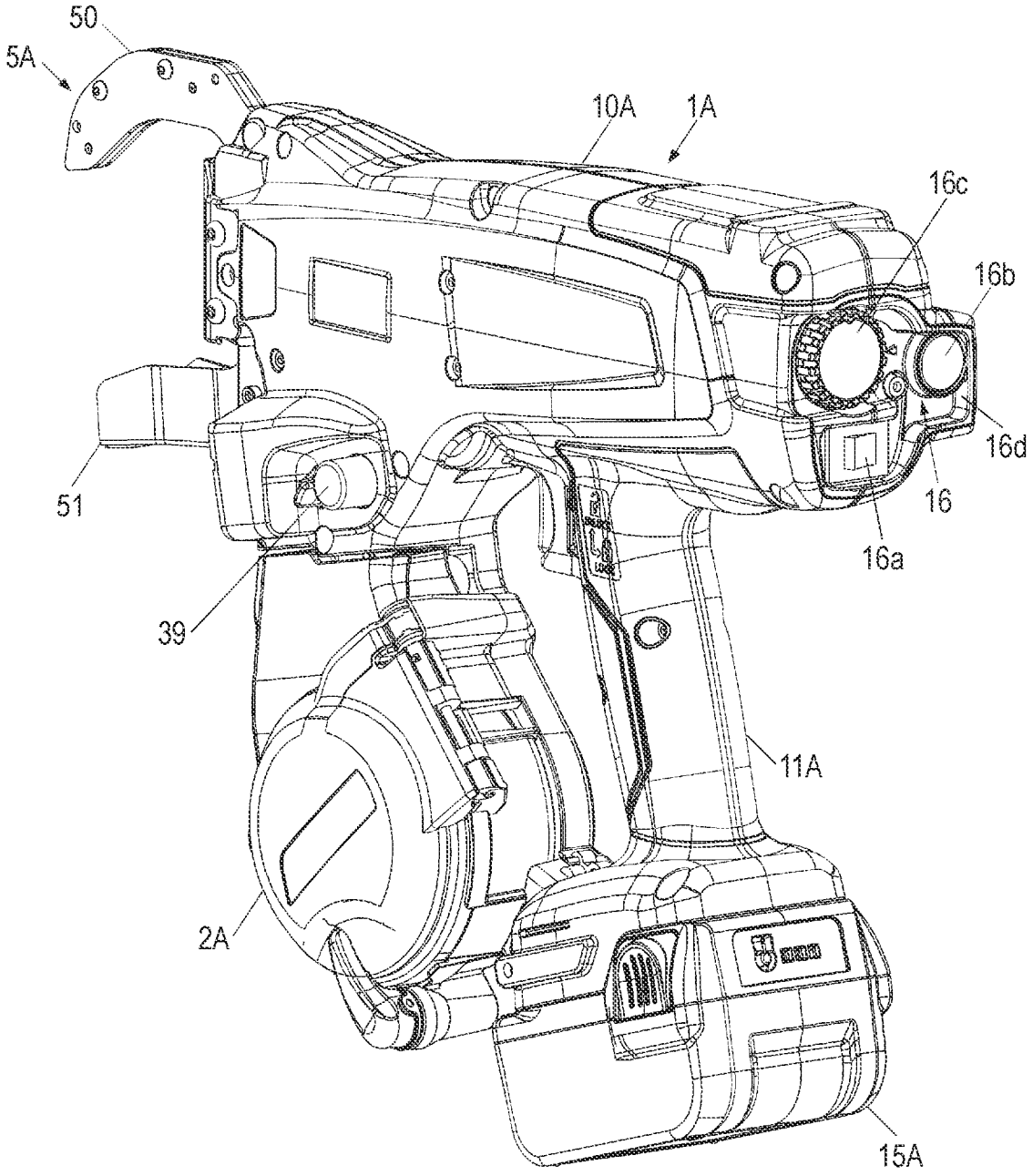
FIG. 1C is a perspective view showing the example of the reinforcing bar binding machine.

FIG. 1A is a side view showing an example of the reinforcing bar binding machine, FIG. 1B is a side view showing an example of an internal configuration of the reinforcing bar binding machine, and FIG. 1C is a perspective view showing the example of the reinforcing bar binding machine. A reinforcing bar binding machine 1A is in a form of being held in a hand of an operator for use, and includes a main body portion 10A and a handle portion 11A.

In addition, the reinforcing bar binding machine 1A feeds a wire W in a forward direction, which is a first direction indicated by an arrow F, winds the wire W around reinforcing bars S, which are objects to be bound, feeds the wire W wound around the reinforcing bars S in a backward direction, which is a second direction indicated by an arrow R, winds the wire W around the reinforcing bars S, twists the wire W, and binds the reinforcing bars S with the wire W.

In order to implement the functions described above, the reinforcing bar binding machine 1A includes a magazine 2A in which the wire W is stored, a wire feeding unit 3A that feeds the wire W, and a wire guide 4A that guides the wire W fed to the wire feeding unit 3A. In addition, the reinforcing bar binding machine 1A includes a curl forming unit 5A that forms a path for winding, around the reinforcing bars S, the wire W fed by the wire feeding unit 3A, and a cutting unit 6A that cuts the wire W wound around the reinforcing bars S. Further, the reinforcing bar binding machine 1A includes a binding unit 7A that twists the wire W wound around the reinforcing bars S, and a driving unit 8A that drives the binding unit 7A.

The magazine 2A rotatably and detachably stores a reel 20 on which the elongated wire W is wound such that the wire W can be unwound. As the wire W, a wire formed of a plastically deformable metal wire, a wire obtained by coating a metal wire with a resin, or a twisted wire is used. The reel 20 has a bobbin portion (not shown) around which one or more wires W are wound, and a wire W or a plurality of wires W can be pulled out from the reel 20.

The wire feeding unit 3A includes a pair of feed gears 30 (first feed gear 30L, second feed gear 30R) that feed the wire W by a rotation operation, as a pair of feed members that clamp and feed a wire W or a plurality of wires W arranged in parallel. The wire feeding unit 3A rotates the pair of feed gears 30 by transmission of a rotation operation of a feed motor, which will be described later. Accordingly, the wire feeding unit 3A feeds, along an extending direction of the wire W, the wire W clamped between the pair of feed gears 30. In a configuration in which a plurality of, for example, two wires W are fed, the wires W are fed in a state in which the two wires W are arranged in parallel.

The curl forming unit 5A includes a curl guide 50, which is an example of a first guide unit that imparts curl to the wire W fed by the wire feeding unit 3A, and a leading guide 51, which is an example of a second guide unit that leads, to the binding unit 7A, the wire W curled by the curl guide 50. In the reinforcing bar binding machine 1A, a path of the wire W fed by the wire feeding unit 3A is regulated by the curl forming unit 5A, so that a trajectory of the wire W is a loop Ru as indicated by a chain double-dashed line in FIG. 1B, and the wire W is wound around the reinforcing bars S.

The cutting unit 6A includes a fixed blade portion (not shown), a movable blade portion (not shown) that cuts the wire W in cooperation with the fixed blade portion, and a transmission mechanism 62 that transmits an operation of the binding unit 7A to the movable blade portion. The transmission mechanism 62 transmits the operation of the binding unit 7A to the cutting unit 6A via a moving member 83, and cuts the wire W in conjunction with the operation of the binding unit 7A.

The binding unit 7A includes a wire locking body 70 that locks the wire W. A detailed embodiment of the binding unit 7A will be described later. The driving unit 8A includes a motor 80 and a reduction gear 81 that reduces a speed and amplifies a torque.

The reinforcing bar binding machine 1A includes a feed regulating unit 90 with which a tip of the wire W abuts against a feed path of the wire W locked by the wire locking body 70. In addition, in the reinforcing bar binding machine 1A, the curl guide 50 and the leading guide 51 of the curl forming unit 5A described above are provided on a front end of the main body portion 10A. Further, in the reinforcing bar binding machine 1A, an abutting portion 91 against which the reinforcing bars S are abutted is provided between the curl guide 50 and the leading guide 51 at the front end of the main body portion 10A.

In addition, in the reinforcing bar binding machine 1A, the handle portion 11A extends downward from the main body portion 10A. Further, a battery 15A is detachably attached to a lower portion of the handle portion 11A. In addition, in the reinforcing bar binding machine 1A, the magazine 2A is provided in front of the handle portion 11A. In the reinforcing bar binding machine 1A, the wire feeding unit 3A, the cutting unit 6A, the binding unit 7A, the driving unit 8A that drives the binding unit 7A, and the like described above are stored in the main body portion 10A.

In the reinforcing bar binding machine 1A, a trigger 12A is provided on a front side of the handle portion 11A, and an operation switch 13A is provided inside the handle portion 11A. In addition, a substrate 100 on which a circuit forming a control unit 14A, which will be described later, and the like are mounted is provided on the main body portion 10A.

The reinforcing bar binding machine 1A includes an operation unit 16 that receives operations of turning on and off a power, setting a binding strength of the wire W, automatically loading the wire W, automatically unloading the wire W, and the like. The operation unit 16 is provided on a rear surface of the main body portion 10A, and includes a power switch 16*a* that turns on and off the power, and an automatic loading and unloading switch 16*b* that receives an operation of executing an automatic loading and unloading mode. In addition, the operation unit 16 includes a torque dial 16*c* capable of selecting the binding strength of the wire W, as an example of a binding force setting unit capable of setting the binding strength of the wire W.

The operation unit 16 includes a convex portion 16*d* that protrudes rearward from the main body portion 10A around the power switch 16*a*, the automatic loading and unloading switch 16*b*, and the torque dial 16*c*, so that positions where the power switch 16*a*, the automatic loading and unloading switch 16*b*, and the torque dial 16*c* are provided are concaved. Accordingly, the power switch 16*a*, the automatic loading and unloading switch 16*b*, and the torque dial 16*c* do not protrude rearward from the main body portion 10A, thereby preventing a malfunction. In addition, since the wire W is unloaded and loaded after the power is turned off and on, an operability is improved by providing the automatic loading and unloading switch 16*b* near the power switch 16*a*, and by providing the automatic loading and unloading switch 16*b* and the power switch 16*a* on the same operation unit 16 in this example.

Figure 2A:
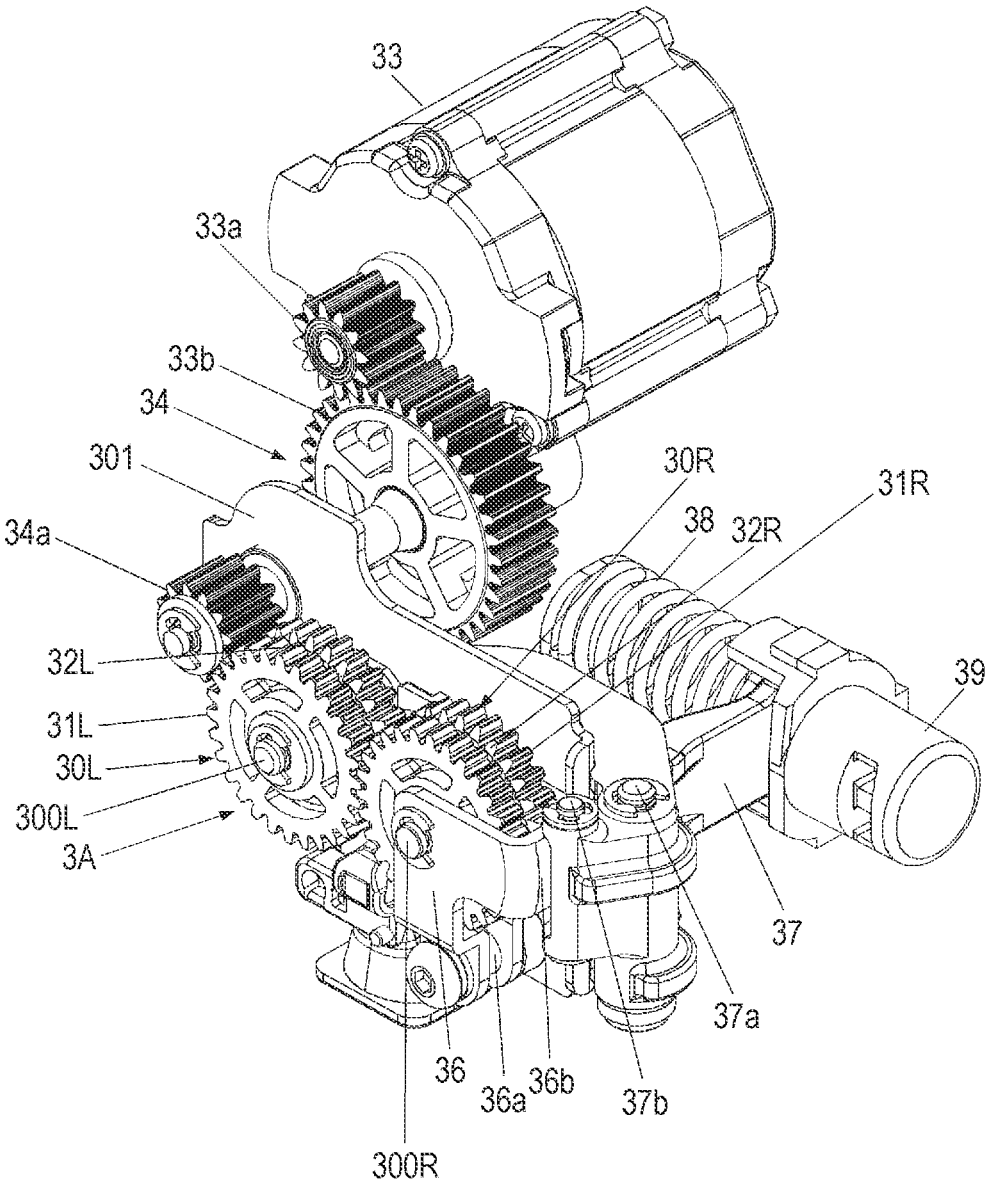
FIG. 2A is a perspective view showing an example of a wire feeding unit.
Figure 2B:
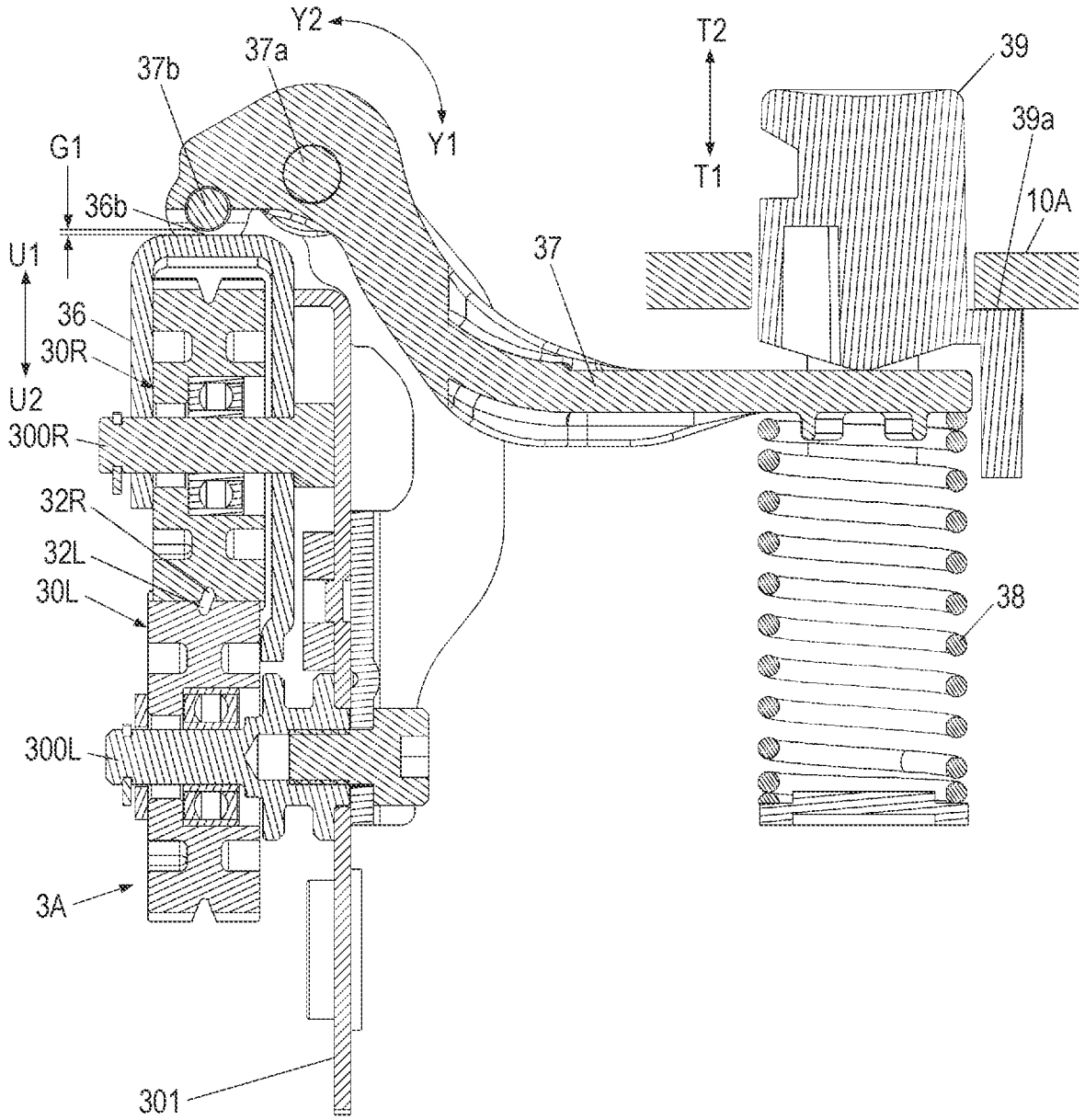
FIG. 2B is a cross-sectional view showing an example of an operation of the wire feeding unit during wire loading.
Figure 2C:
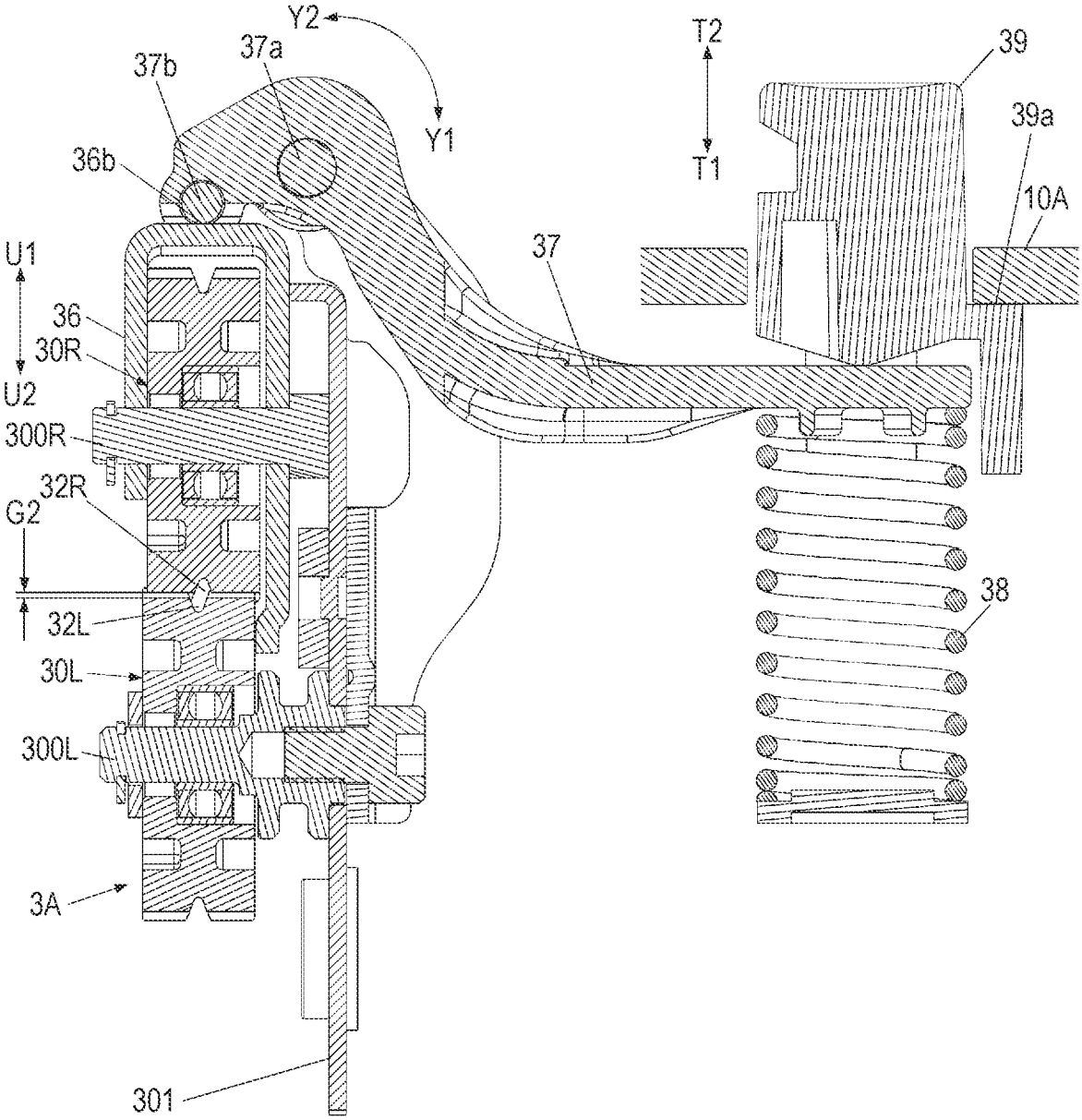
FIG. 2C is a cross-sectional view showing an example of an operation of the wire feeding unit during wire loading.

FIG. 2A is a perspective view showing an example of a wire feeding unit, FIG. 2B and FIG. 2C each is a cross-sectional view showing an example of an operation of the wire feeding unit during wire loading. Next, a configuration of the wire feeding unit 3A will be described with reference to each drawing.

The first feed gear 30L, which is one feed member forming one of the pair of feed gears 30, is rotatably supported on the support member 301 of the wire feeding unit 3A by the shaft 300L. The first feed gear 30L includes a tooth portion 31L that transmits a driving force. In this example, the tooth portion 31L has a shape forming a spur gear, and is formed along an entire outer periphery of the first feed gear 30L. In addition, the first feed gear 30L includes a groove portion 32L into which the wire W is inserted. In this example, the groove portion 32L includes a concave portion having a substantially V-shaped cross section, and is formed along the entire outer periphery of the first feed gear 30L in a circumferential direction.

The second feed gear 30R, which is the other feed member forming the other of the pair of feed gears 30, includes a tooth portion 31R that transmits a driving force. In this example, the tooth portion 31R has a shape forming a spur gear, and is formed along an entire outer periphery of the second feed gear 30R. In addition, the second feed gear 30R includes a groove portion 32R into which the wire W is inserted. In this example, the groove portion 32R includes a concave portion having a substantially V-shaped cross section, and is formed along the entire outer periphery of the second feed gear 30R in a circumferential direction.

In the wire feeding unit 3A, the groove portion 32L of the first feed gear 30L and the groove portion 32R of the second feed gear 30R are opposed to each other, and the first feed gear 30L and the second feed gear 30R are provided with the feed path of the wire W interposed therebetween.

In the wire feeding unit 3A, the tooth portion 31L of the first feed gear 30L and the tooth portion 31R of the second feed gear 30R mesh with each other in a state in which the wire W is clamped between the groove portion 32L of the first feed gear 30L and the groove portion 32R of the second feed gear 30R. Accordingly, a driving force is transmitted between the first feed gear 30L and the second feed gear 30R.

The wire feeding unit 3A includes a feed motor 33 that drives one of the first feed gear 30L and the second feed gear 30R, drives the first feed gear 30L in this example, and a driving force transmission mechanism 34 that transmits a driving force of the feed motor 33 to the first feed gear 30L.

The driving force transmission mechanism 34 includes a small gear 33*a* attached to a shaft of the feed motor 33 and a large gear 33*b* meshing with the small gear 33*a*. In addition, the driving force transmission mechanism 34 includes a feed small gear 34*a* to which a driving force is transmitted from the large gear 33*b* and which meshes with the first feed gear 30L. Each of the small gear 33*a*, the large gear 33*b* and the feed small gear 34*a* includes a spur gear.

A rotation operation of the feed motor 33 is transmitted to the first feed gear 30L via the driving force transmission mechanism 34 to rotate the first feed gear 30L. A rotation operation of the first feed gear 30L is transmitted to the second feed gear 30R by meshing between the tooth portion 31L and the tooth portion 31R, and the second feed gear 30R rotates following the first feed gear 30L.

Accordingly, the wire feeding unit 3A feeds, along the extending direction of the wire W, the wire W clamped between the first feed gear 30L and the second feed gear 30R. In a configuration of feeding two wires W, the two wires W are fed in parallel by a frictional force generated between the groove portion 32L of the first feed gear 30L and one wire W, a frictional force generated between the groove portion 32R of the second feed gear 30R and the other wire W, and a frictional force generated between the one wire W and the other wire W.

In the wire feeding unit 3A, by switching a rotation direction of the feed motor 33 between a forward direction and a backward direction, rotation directions of the first feed gear 30L and the second feed gear 30R are switched, and a feed direction of the wire W is switched between a forward direction and a backward direction.

Since the wire feeding unit 3A clamps the wire W between the first feed gear 30L and the second feed gear 30R, the wire feeding unit 3A includes a configuration in which the first feed gear 30L and the second feed gear 30R are pressed in a direction in which the first feed gear 30L and the second feed gear 30R approach each other. That is, in order to allow the wire feeding unit 3A to load one wire W between the first feed gear 30L and the second feed gear 30R while clamping the other wire W between the first feed gear 30L and the second feed gear 30R, the first feed gear 30L and the second feed gear 30R are configured to be displaceable in a direction in which the first feed gear 30L and the second feed gear 30R separate from and contact with each other. In this example, the driving force of the feed motor 33 is received by the first feed gear 30L, and the second feed gear 30R to which the driving force of the feed motor 33 is not directly transmitted is displaced with respect to the first feed gear 30L.

Therefore, the wire feeding unit 3A includes a first displacement member 36 that displaces the second feed gear 30R with respect to the first feed gear 30L in a direction to approach and separate from the first feed gear 30L. In addition, the wire feeding unit 3A includes a second displacement member 37 that displaces the first displacement member 36. The first displacement member 36 and the second displacement member 37 are examples of a displacement unit, and displace one or both of the pair of feed gears 30 in a direction to approach and separate from each other. In this example, as described above, the second feed gear 30R is displaced with respect to the first feed gear 30L in the direction to approach and separate from the first feed gear 30L.

The second feed gear 30R is rotatably supported on one end side of the first displacement member 36 by a shaft 300R. The shaft 300L of the first feed gear 30L and the shaft 300R of the second feed gear 30R are parallel to each other. In addition, the other end of the first displacement member 36 is rotatably supported on the support member 301 of the wire feeding unit 3A with the shaft 36*a* as a fulcrum.

In the first displacement member 36, the shaft 36*a*, which is the fulcrum for the rotation operation, is oriented parallel to the shaft 300R of the second feed gear 30R. Accordingly, the first displacement member 36 is displaced by the rotation operation with the shaft 36*a* as a fulcrum, and causes the second feed gear 30R to separate from and contact with the first feed gear 30L.

The first displacement member 36 includes a pressed portion 36*b* on the one end side which is pressed by the second displacement member 37. The pressed portion 36*b* is provided on a side of a portion supporting the shaft 300R of the second feed gear 30R.

The second displacement member 37 is rotatably supported on the support member 301 of the wire feeding unit 3A with a shaft 37*a* as a fulcrum. In addition, the second displacement member 37 includes a pressing portion 37*b*, which presses the pressed portion 36*b* of the first displacement member 36, on one end side with the shaft 37*a* therebetween.

The second displacement member 37 is displaced by the rotation operation with the shaft 37*a* as a fulcrum to press the pressed portion 36*b* of the first displacement member 36 by the pressing portion 37*b*, and release the pressing of the pressed portion 36*b* by the pressing portion 37*b*.

The wire feeding unit 3A includes a spring 38 that presses the second feed gear 30R against the first feed gear 30L. The spring 38 includes, for example, a compression coil spring, and presses the other end side of the second displacement member 37 with the shaft 37*a* therebetween.

The second displacement member 37 is pressed by the spring 38 and displaced by the rotation operation with the shaft 37*a* as a fulcrum to press the pressed portion 36*b* of the first displacement member 36 by the pressing portion 37*b*. When the pressing portion 37*b* of the second displacement member 37 presses the pressed portion 36*b* of the first displacement member 36, the first displacement member 36 is displaced by the rotation operation with the shaft 36*a* as a fulcrum. Accordingly, the second feed gear 30R is pressed toward the first feed gear 30L by a force of the spring 38.

When the wire W is loaded between the first feed gear 30L and the second feed gear 30R, the wire W is clamped between the groove portion 32L of the first feed gear 30L and the groove portion 32R of the second feed gear 30R.

In addition, the tooth portion 31L of the first feed gear 30L and the tooth portion 31R of the second feed gear 30R mesh with each other in a state in which the wire W is clamped between the groove portion 32L of the first feed gear 30L and the groove portion 32R of the second feed gear 30R.

The wire feeding unit 3A includes an operation button 39 that displaces the second displacement member 37. The operation button 39 is an example of an operation member, and is provided at a position facing the spring 38 via the second displacement member 37. The operation button 39 protrudes outward from one side surface of the main body portion 10A and is supported so as to be movable in a direction indicated by an arrow T1 in which the operation button 39 is pressed toward the main body portion 10A and a direction indicated by an arrow T2 in which the operation button 39 protrudes from the main body portion 10A. The spring 38 is contracted by pressing the operation button 39 in the direction indicated by the arrow T1 in which the operation button 39 is pressed toward the main body portion 10A, and the second displacement member 37 sandwiched between the operation button 39 and the spring 38 is displaced by the rotation operation with the shaft 37*a* as a fulcrum and rotated in a direction indicated by an arrow Y1.

When the second displacement member 37 rotates in the direction indicated by the arrow Y1, pressing of the pressed portion 36*b* by the pressing portion 37*b* is released, and the second feed gear 30R supported on the first displacement member 36 is movable in a direction indicated by an arrow U1, which is a direction away from the first feed gear 30L.

When a force for pressing the operation button 39 in the direction indicated by the arrow T1 in which the operation button 39 is pressed toward the main body portion 10A is released, the spring 38 is extended, and the second displacement member 37 sandwiched between the operation button 39 and the spring 38 is displaced by the rotation operation with the shaft 37*a* as a fulcrum and rotated in a direction indicated by an arrow Y2 and the operation button 39 is pushed by the spring 38 and the second displacement member 37 and moves in the direction indicated by the arrow T2 in which the operation button 39 protrudes from the main body portion 10A.

When the second displacement member 37 rotates in the direction indicated by the arrow Y2 by the force of the spring 38, the pressing portion 37*b* presses the pressed portion 36*b* of the first displacement member 36, and the second feed gear 30R supported on the first displacement member 36 is pressed by the force of the spring 38 in a direction indicated by an arrow U2, which is a direction approaching the first feed gear 30L. Accordingly, one wire W inserted into the groove portion 32L of the first feed gear 30L and the other wire W inserted into the groove portion 32R of the second feed gear 30R are clamped between the first feed gear 30L and the second feed gear 30R.

The wire feeding unit 3A includes a holding unit 39*a* that secures an interval between the first feed gear 30L and the second feed gear 30R in a state in which the wire W is not inserted between the first feed gear 30L and the second feed gear 30R. The holding unit 39*a* is an example of a holding member, and is provided on the operation button 39 in this example. The holding unit 39*a* protrudes from a side of the operation button 39, and abuts, by pressing the operation button 39 in the direction indicated by the arrow T2 by the force of the spring 38 via the second displacement member 37, against an inner surface of the main body portion 10A at a portion where the operation button 39 is movably provided.

Accordingly, by regulating a movement range of the operation button 39, which is pressed by the spring 38 via the second displacement member 37, in the direction indicated by the arrow T2, a movement range of the second displacement member 37, which is pressed by the spring 38, by the rotation operation in the direction indicated by the arrow Y2 with the shaft 37*a* as a fulcrum is regulated.

When the holding unit 39*a* of the operation button 39 is abutted against the main body portion 10A, as shown in FIG. 2B, a gap G1 can be formed between the pressing portion 37*b* of the second displacement member 37 and the pressed portion 36*b* of the first displacement member 36. Therefore, the second feed gear 30R can move by the gap G1 in a direction away from the first feed gear 30L without receiving the force of the spring 38.

Accordingly, as shown in FIG. 2C, a state in which a gap G2 can be formed between the first feed gear 30L and the second feed gear 30R is maintained in the state in which the wire W is not inserted between the first feed gear 30L and the second feed gear 30R.

Figure 3A:
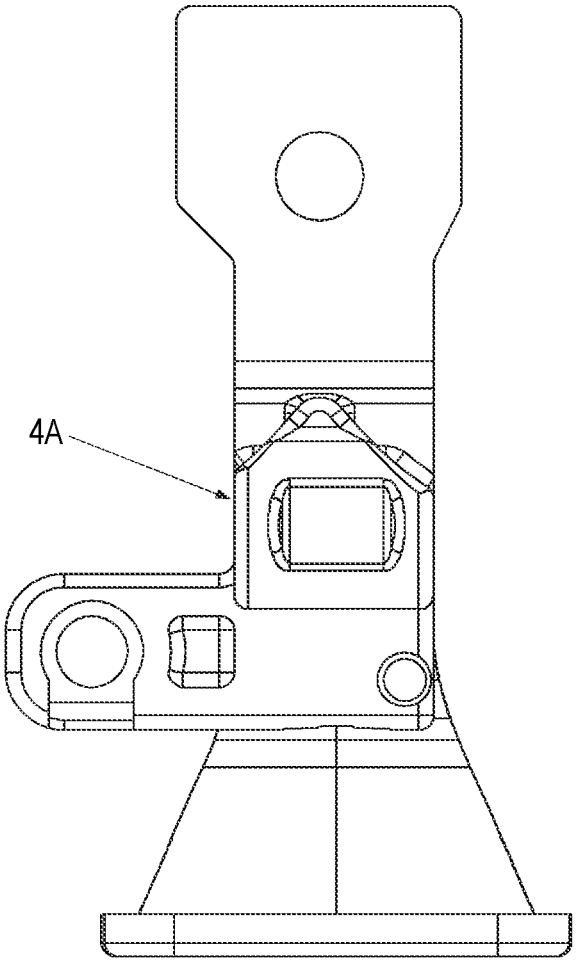
FIG. 3A is a side view showing an example of a wire guide.
Figure 3B:
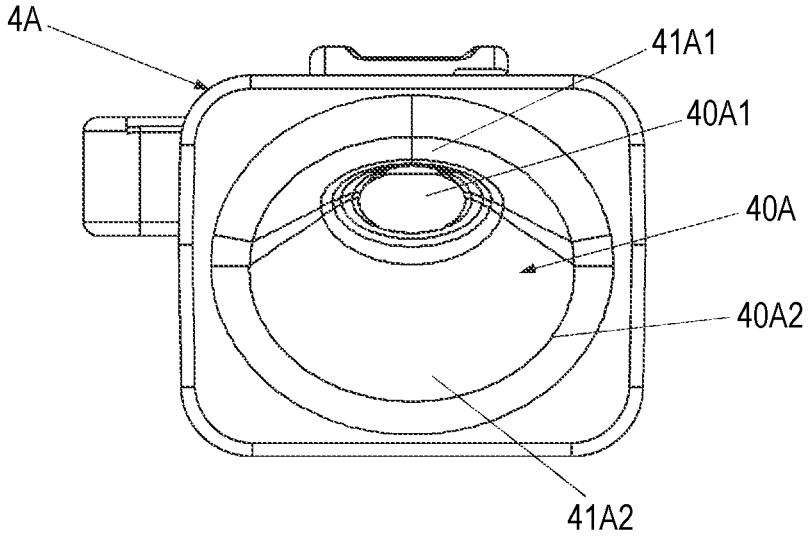
FIG. 3B is a bottom view showing the example of the wire guide.
Figure 3C:
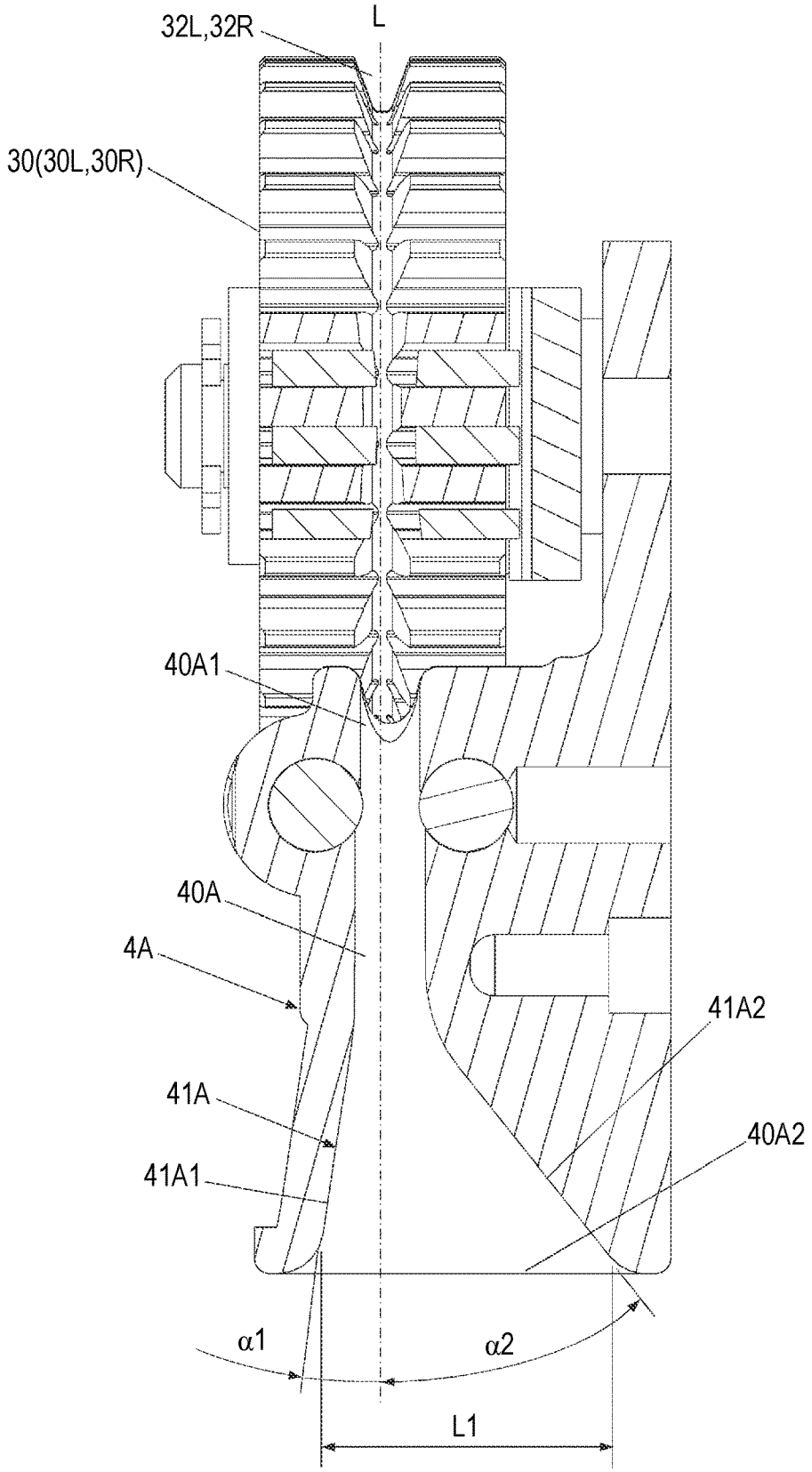
FIG. 3C is a side cross-sectional view showing an example of a wire feeding unit and the wire guide.
Figure 3D:
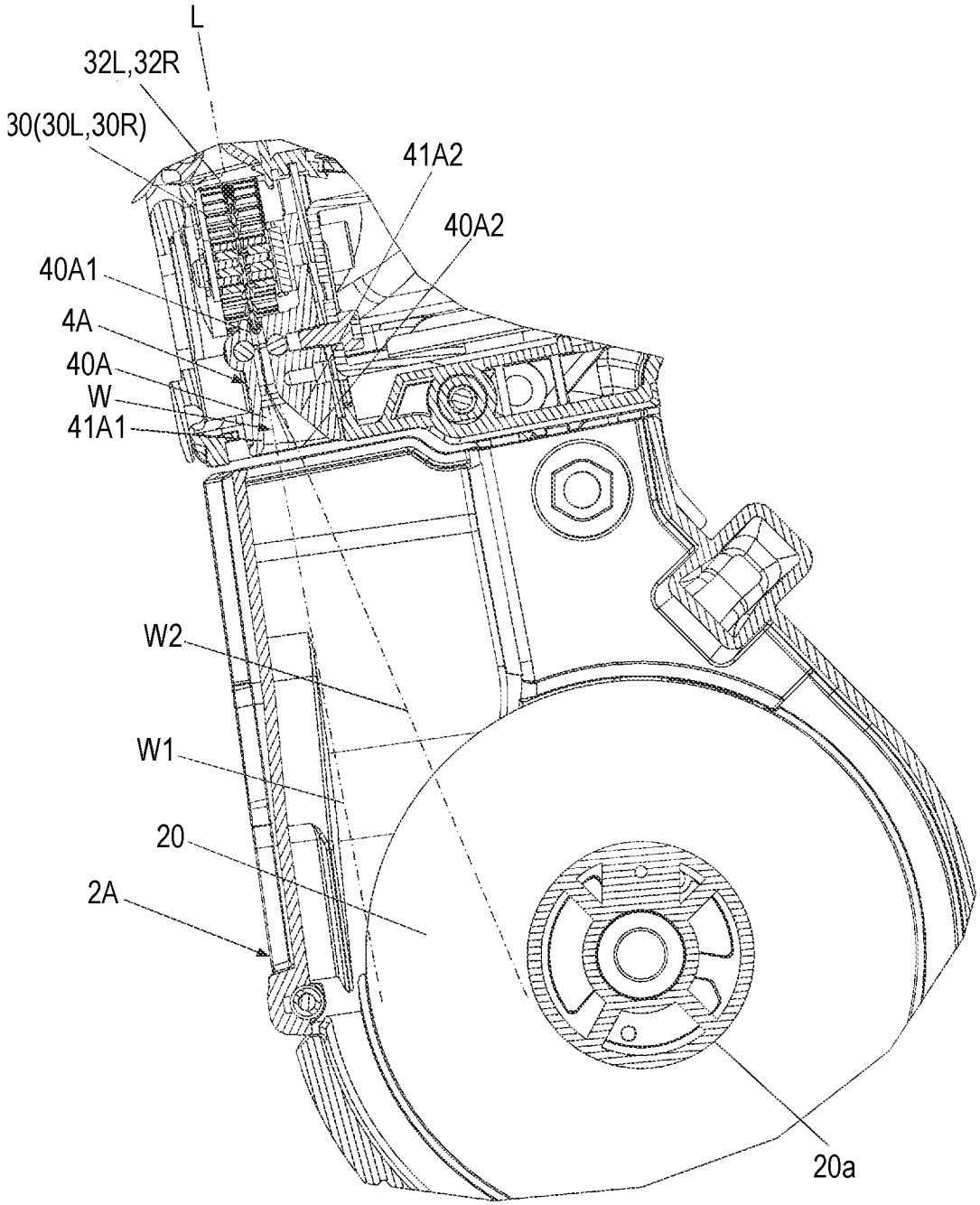
FIG. 3D is an enlarged cross-sectional view of a main part of the reinforcing bar binding machine showing a relationship between the wire guide and the wire feeding unit.

FIG. 3A is a side view showing an example of a wire guide, FIG. 3B is a bottom view showing the example of the wire guide, FIG. 3C is a side cross-sectional view showing an example of a wire feeding unit and the wire guide, FIG. 3D is an enlarged cross-sectional view of a main part of the reinforcing bar binding machine showing a relationship between the wire guide and the wire feeding unit. Next, a configuration of the wire guide will be described with reference to each drawing.

The wire guide 4A is disposed at an upstream side of the feed gears 30 (the first feed gear 30L and the second feed gear 30R) with respect to the feed direction of the wire W fed in the forward direction. In a configuration in which the reinforcing bar binding machine 1A binds reinforcing bars with two wires W, the wire guide 4A aligns the two inserted wires W in a row along a direction in which the first feed gear 30L and the second feed gear 30R are arranged, and guides the two wires W between the first feed gear 30L and the second feed gear 30R.

The wire guide 4A includes a guide hole 40A through which each wire W passes. In the guide hole 40A, a lead-out side opening 40A1 on a downstream side with respect to the feed direction of the wire W fed in the forward direction includes an oval or elliptical opening whose longitudinal direction is along the direction in which the first feed gear 30L and the second feed gear 30R are arranged.

The lead-out side opening 40A1 has a length in the longitudinal direction approximately twice a diameter of the wire W, and a length in a lateral direction approximately equal to the diameter of the wire W. Accordingly, a direction in which the two wires W lead out from the lead-out side opening 40A1 through the wire guide 4A are aligned in a row is regulated.

The guide hole 40A is configured such that a lead-in side opening 40A2 on an upstream side with respect to the feed direction of the wire W fed in the forward direction has an opening area larger than that of the lead-out side opening 40A1 on the downstream side. Accordingly, a part or all of an inner surface between the lead-in side opening 40A2 and the lead-out side opening 40A1 is tapered, and the guide hole 40A has a conical shape whose opening area gradually decreases from the lead-in side opening 40A2 toward the lead-out side opening 40A1.

The wire guide 4A includes a leading unit 41A (41A1, 41A2) for the wire W between the lead-in side opening 40A2 and the lead-out side opening 40A1. The leading unit 41A includes a leading unit 41A1 positioned outside in a winding direction of the wire W wound on the reel 20 stored in the magazine 2A with respect to the wire W lead into the wire guide 4A, and a leading unit 41A2 positioned inside in the winding direction of the wire W with respect to the wire W lead into the wire guide 4A. The leading unit 41A1 and the leading unit 41A2 include an inner surface of the guide hole 40A between the lead-in side opening 40A2 and the lead-out side opening 40A1, and a portion or an entire portion between the lead-in side opening 40A2 and the lead-out side opening 40A1 is tapered.

At a portion where the first feed gear 30L and the second feed gear 30R face each other, the wire W clamped between the groove portion 32L and groove portion 32R passes through a center along an axial direction of the first feed gear 30L and the second feed gear 30R. Therefore, a path through which the wire W passes is called a reference path L, and the path is obtained by connecting, with a straight line, a center of the lead-out side opening 40A1 in the lateral direction, and the center along the axial direction of the first feed gear 30L and the second feed gear 30R provided with the groove portion 32L and the groove portion 32R at the portion where the first feed gear 30L and the second feed gear 30R face each other.

When an extending direction of the wire W passing through the wire guide 4A approaches parallel to the reference path L, by an operation of inserting the wire W between the first feed gear 30L and the second feed gear 30R by the user of the reinforcing bar binding machine 1A, a success rate of the tip of the wire W passing through the wire guide 4A entering between the groove portion 32L of the first feed gear 30L and the groove portion 32R of the second feed gear 30R increases.

The path through which the wire W lead into the wire guide 4A passes changes according to an amount of the wire W wound on the reel 20. As a path through which the wire W passes between the wire guide 4A and the reel 20 stored in the magazine 2A, a path when the amount of the wire W wound on the reel 20 is large is indicated by W1 in FIG. 3D, and a path when the amount of the wire W wound on the reel 20 is small is indicated by W2 in FIG. 3D.

When the amount of the wire W wound on the reel 20 is large, the wire W is pulled out from the vicinity of the outer periphery of the reel 20, and therefore, a path W1 through which the wire W lead into the wire guide 4A passes is a path along the reference path L.

In an operation of storing the reel 20 in the magazine 2A and loading the wire W, the user of the reinforcing bar binding machine 1A inserts the wire W from the wire guide 4A between the first feed gear 30L and the second feed gear 30R. Since a new reel 20 has a large amount of wire W wound thereon, the wire W is pulled out from the vicinity of the outer periphery of the reel 20. Accordingly, the wire W inserted into the wire guide 4A from the lead-in side opening 40A2 is lead to the lead-out side opening 40A1 along the leading unit 41A1 in a direction along the axial direction of the first feed gear 30L and the second feed gear 30R.

Therefore, in order to make the extending direction of the wire W passing through the wire guide 4A approach parallel to the reference path L, among angles of the leading unit 41A of the wire guide 4A with respect to the reference path L, the smaller the angle $\alpha$1 of the leading unit 41A1 along the axial direction of the first feed gear 30L and the second feed gear 30R, the better.

In the wire guide 4A, the leading unit 41A (41A1, 41A2) on a side closer to the lead-out side opening 40A1 may be parallel to the reference path L, and in this case, in the wire guide 4A, the angle $\alpha$ of the leading unit 41A (41A1, 41A2) on a side closer to the lead-out side opening 40A1 with respect to the reference path L is 0°.

However, in the wire guide 4A, when the angle $\alpha$ of the leading unit 41A (41A1, 41A2) on a side closer to the lead-in side opening 40A2 with respect to the reference path L is smaller, a length L1 of the lead-in side opening 40A2 along the axial direction of the first feed gear 30L and the second feed gear 30R is reduced. When the length L1 of the lead-in side opening 40A2 is reduced, it is difficult to insert the wire W into the guide hole 40A.

On the other hand, as described above, the angle $\alpha$1 of the leading unit 41A1 with respect to the reference path L should be as small as possible. Therefore, although it is preferable that the angle $\alpha$1 of the leading unit 41A1 with respect to the reference path L is as small as possible, from the viewpoint of ensuring the length L1 of the lead-in side opening 40A2, the angle $\alpha$1 of the leading unit 41A1 with respect to the reference path L is preferably 0° or more and 17° or less, and more preferably more than 0° and 9° or less.

On the other hand, when the amount of the wire W wound on the reel 20 is small, the wire W is pulled out from the vicinity of a bobbin portion 20*a* at a center of the reel 20, and therefore, a path W2 through which the wire W lead into the wire guide 4A passes is a path inclined inward in the winding direction of the wire W wound on the reel 20 with respect to the reference path L.

Thus, among the angles of the leading unit 41A of the wire guide 4A with respect to the reference path L, if the angle $\alpha$2 of the leading unit 41A2 along the axial direction of the first feed gear 30L and the second feed gear 30R is reduced, when the amount of the wire W wound on the reel 20 is small, the wire W fed by a binding operation may come into contact with the leading unit 41A2, which may become a load during the operation of feeding the wire W or cause the wire W to be creased.

Therefore, among the angles of the leading unit 41A of the wire guide 4A with respect to the reference path L, the angle $\alpha$2 of the leading unit 41A2 along the axial direction of the first feed gear 30L and the second feed gear 30R preferably has a lower limit value of 10° or more, and an upper limit value of less than 90°. The angle $\alpha$2 of the leading unit 41A2 with respect to the reference path L is preferably 10° or more and 70° or less, and more preferably 10° or more and 50° or less.

Figure 4A:
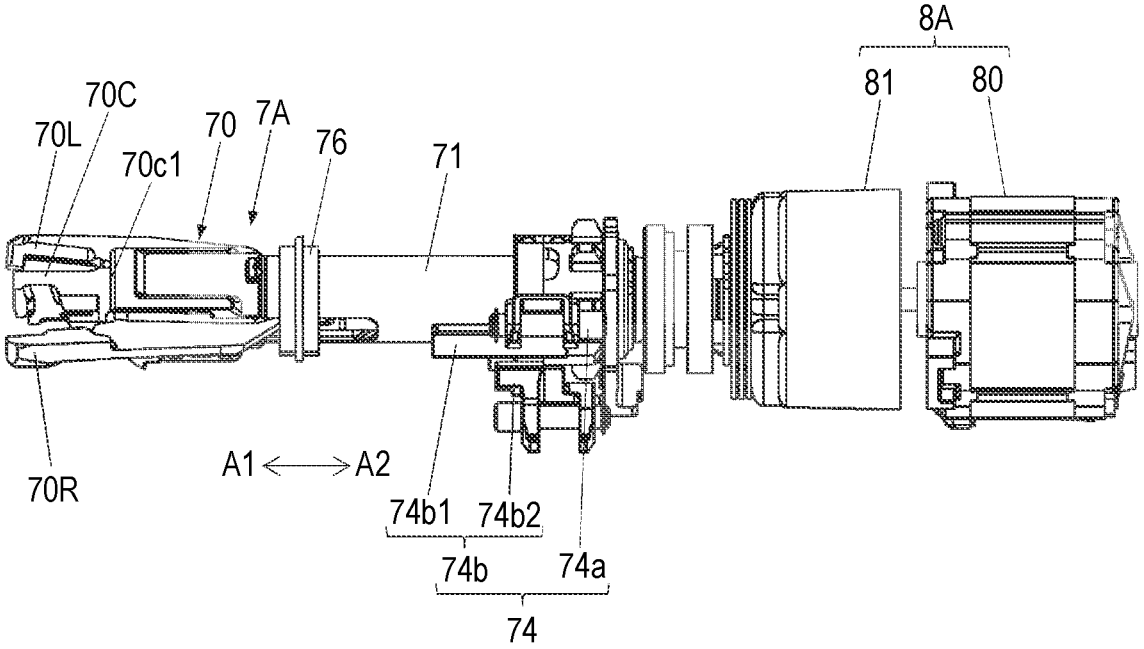
FIG. 4A is a perspective view showing an example of a binding unit.
Figure 4B:
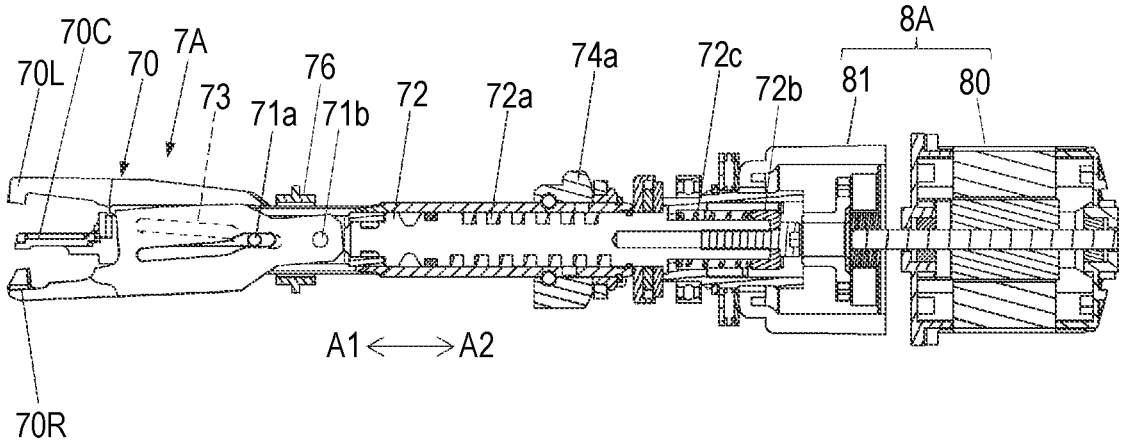
FIG. 4B is a cross-sectional plan view showing the example of the binding unit.
Figure 4C:
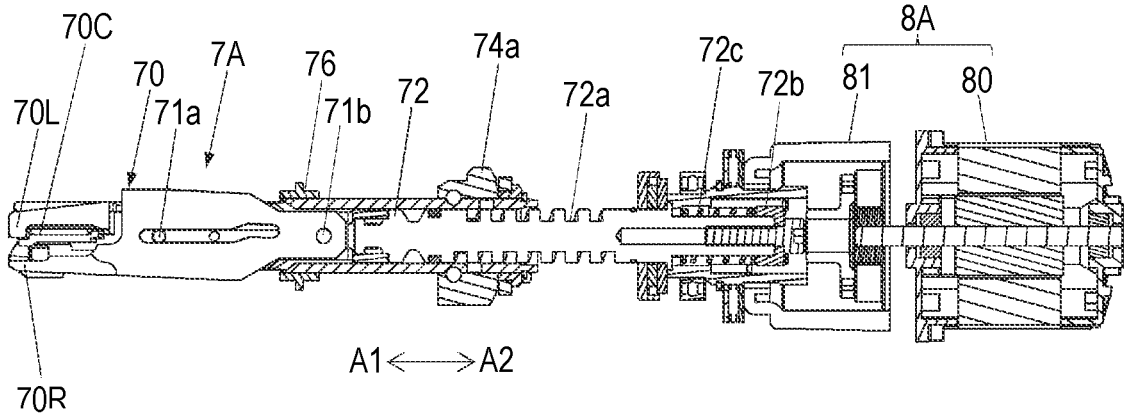
FIG. 4C is a cross-sectional plan view showing the example of the binding unit.

FIG. 4A is a perspective view showing an example of a binding unit, FIG. 4B and FIG. 4C each is a cross-sectional plan view showing the example of the binding unit. Next, a configuration of the binding unit will be described with reference to each drawing.

The binding unit 7A includes the wire locking body 70 that locks the wire W and a rotation shaft 72 that actuates the wire locking body 70. In the binding unit 7A and the driving unit 8A, the rotation shaft 72 and the motor 80 are connected via the reduction gear 81, and the rotation shaft 72 is driven by the motor 80 via the reduction gear 81.

The wire locking body 70 includes a center hook 70C connected to the rotation shaft 72, a first side hook 70R and a second side hook 70L that are opened and closed with respect to the center hook 70C, and a sleeve 71 that actuates the first side hook 70R and the second side hook 70L and forms the wire W into a desired shape.

In the binding unit 7A, a side on which the center hook 70C, the first side hook 70R, and the second side hook 70L are provided is defined as a front side, and a side on which the rotation shaft 72 is connected to the reduction gear 81 is defined as a rear side.

The center hook 70C is connected to a front end, which is one end portion of the rotation shaft 72, via a configuration that is rotatable with respect to the rotation shaft 72 and is movable in an axial direction integrally with the rotation shaft 72.

A tip side of the first side hook 70R, which is one end portion along the axial direction of the rotation shaft 72, is located on one side portion of the center hook 70C. In addition, a rear end side of the first side hook 70R, which is the other end portion along the axial direction of the rotation shaft 72, is rotatably supported on the center hook 70C by a shaft 71*b*.

A tip side of the second side hook 70L, which is one end portion along the axial direction of the rotation shaft 72, is located on the other side portion of the center hook 70C. In addition, a rear end side of the second side hook 70L, which is the other end portion along the axial direction of the rotation shaft 72, is rotatably supported on the center hook 70C by the shaft 71*b*.

Accordingly, the wire locking body 70 is opened and closed in a direction in which the tip side of the first side hook 70R is separated from and contacted with the center hook 70C by a rotation operation with the shaft 71*b* as a fulcrum. In addition, the wire locking body 70 is opened and closed in a direction in which the tip side of the second side hook 70L is separated from and contacted with the center hook 70C.

A rear end, which is the other end portion, of the rotation shaft 72 is connected to the reduction gear 81 via a connecting portion 72*b* that is rotatable integrally with the reduction gear 81 and is movable in the axial direction with respect to the reduction gear 81. The connecting portion 72*b* includes a spring 72*c* that biases the rotation shaft 72 rearward, which is a direction approaching the reduction gear 81. Accordingly, the rotation shaft 72 is configured to be movable forward, which is a direction away from the reduction gear 81, while receiving a force pulled backward by the spring 72*c*.

The sleeve 71 is rotatably and axially slidably supported by a support frame 76. The support frame 76 is an annular member, and is attached to the main body portion 10A in a form that cannot rotate in a circumferential direction and cannot move in the axial direction.

The sleeve 71 includes a convex portion (not shown) that protrudes from an inner peripheral surface of a space into which the rotation shaft 72 is inserted, and the convex portion enters a groove portion of a feed screw 72*a* formed on an outer periphery of the rotation shaft 72 along the axial direction. When the rotation shaft 72 rotates, the sleeve 71 moves in a front-rear direction, which is a direction along the axial direction of the rotation shaft 72, in accordance with a rotation direction of the rotation shaft 72, by an action between the convex portion (not shown) and the feed screw 72*a* of the rotation shaft 72. In addition, the sleeve 71 rotates integrally with the rotation shaft 72.

The sleeve 71 includes an opening and closing pin 71*a* that opens and closes the first side hook 70R and the second side hook 70L.

The opening and closing pin 71*a* is inserted into an opening and closing guide hole 73 provided in the first side hook 70R and the second side hook 70L. The opening and closing guide hole 73 extends along a moving direction of the sleeve 71, and has a shape that converts a linear movement of the opening and closing pin 71*a* moving in conjunction with the sleeve 71 into an opening and closing operation caused by rotation of the first side hook 70R and the second side hook 70L with the shaft 71*b* as a fulcrum.

In the wire locking body 70, when the sleeve 71 moves in a rearward direction indicated by an arrow A2, the first side hook 70R and the second side hook 70L move in a direction away from the center hook 70C by the rotation operation with the shaft 71*b* as a fulcrum according to a trajectory of the opening and closing pin 71*a* and the shape of the opening and closing guide hole 73.

Accordingly, the first side hook 70R and the second side hook 70L are opened with respect to the center hook 70C, and a feed path through which the wire W passes is formed between the first side hook 70R and the center hook 70C and between the second side hook 70L and the center hook 70C.

When the first side hook 70R and the second side hook 70L are opened with respect to the center hook 70C, the wire W fed by the wire feeding unit 3A passes between the center hook 70C and the first side hook 70R. The wire W passing between the center hook 70C and the first side hook 70R is lead to the curl forming unit 5A. Then, the wire W, which is curled by the curl forming unit 5A and lead to the binding unit 7A, passes between the center hook 70C and the second side hook 70L.

In the wire locking body 70, when the sleeve 71 moves in a forward direction indicated by an arrow A1, the first side hook 70R and the second side hook 70L move in a direction approaching the center hook 70C by the rotation operation with the shaft 71*b* as a fulcrum according to a trajectory of the opening and closing pin 71*a* and the shape of the opening and closing guide hole 73. Accordingly, the first side hook 70R and the second side hook 70L are closed with respect to the center hook 70C.

When the first side hook 70R is closed with respect to the center hook 70C, the wire W sandwiched between the first side hook 70R and the center hook 70C is locked in a form of capable of moving between the first side hook 70R and the center hook 70C. In addition, when the second side hook 70L is closed with respect to the center hook 70C, the wire W sandwiched between the second side hook 70L and the center hook 70C is locked in a form of not coming off from between the second side hook 70L and the center hook 70C.

The sleeve 71 includes a bending unit 71*c*1 that forms the wire W into a predetermined shape by pressing and bending a tip side, which is one end of the wire W, in a predetermined direction, and a bending unit 71*c*2 that forms the wire W into a predetermined shape by pressing and bending a terminal side, which is the other end of the wire W cut by the cutting unit 6A, in a predetermined direction.

When the sleeve 71 moves in the forward direction indicated by the arrow A1, the sleeve 71 presses, by the bending unit 71*c*1, the tip side of the wire W, which is locked by the center hook 70C and the second side hook 70L, and bends the tip side toward the reinforcing bars S side. In addition, when the sleeve 71 moves in the forward direction indicated by the arrow A1, the sleeve 71 presses, by the bending unit 71*c*2, the terminal side of the wire W, which is locked by the center hook 70C and the first side hook 70R and cut by the cutting unit 6A, and bends the terminal side toward the reinforcing bars S side.

The binding unit 7A includes a rotation regulating unit 74 that regulates rotation of the wire locking body 70 and the sleeve 71 interlocked with a rotation operation of the rotation shaft 72. The rotation regulating unit 74 has a rotation regulating blade 74*a* provided on the sleeve 71 and a rotation regulating pawl 74*b* provided on the main body portion 10A.

The rotation regulating blade 74*a* is formed by providing, at predetermined intervals in a circumferential direction of the sleeve 71, a plurality of convex portions radially protruding from an outer periphery of the sleeve 71. The rotation regulating blade 74*a* is fixed to the sleeve 71 and moves and rotates integrally with sleeve 71.

The rotation regulating pawl 74*b* includes a first pawl portion 74*b*1 and a second pawl portion 74*b*2 as a pair of pawl portions facing each other with an interval that allows the rotation regulating blade 74*a* to pass therethrough. The first pawl portion 74*b*1 and the second pawl portion 74*b*2 are configured to be retractable from a trajectory of the rotation regulating blade 74*a* by being pushed by the rotation regulating blade 74*a* according to a rotation direction of the rotation regulating blade 74*a*.

In the rotation regulating unit 74, when the rotation regulating blade 74*a* is locked to the rotation regulating pawl 74*b*, the rotation of the sleeve 71 interlocked with the rotation of the rotation shaft 72 is regulated, and the sleeve 71 moves in the front-rear direction by the rotation operation of the rotation shaft 72. In addition, when the locking of the rotation regulating blade 74*a* to the rotation regulating pawl 74*b* is released, the sleeve 71 rotates in conjunction with the rotation of the rotation shaft 72.

Figure 5:
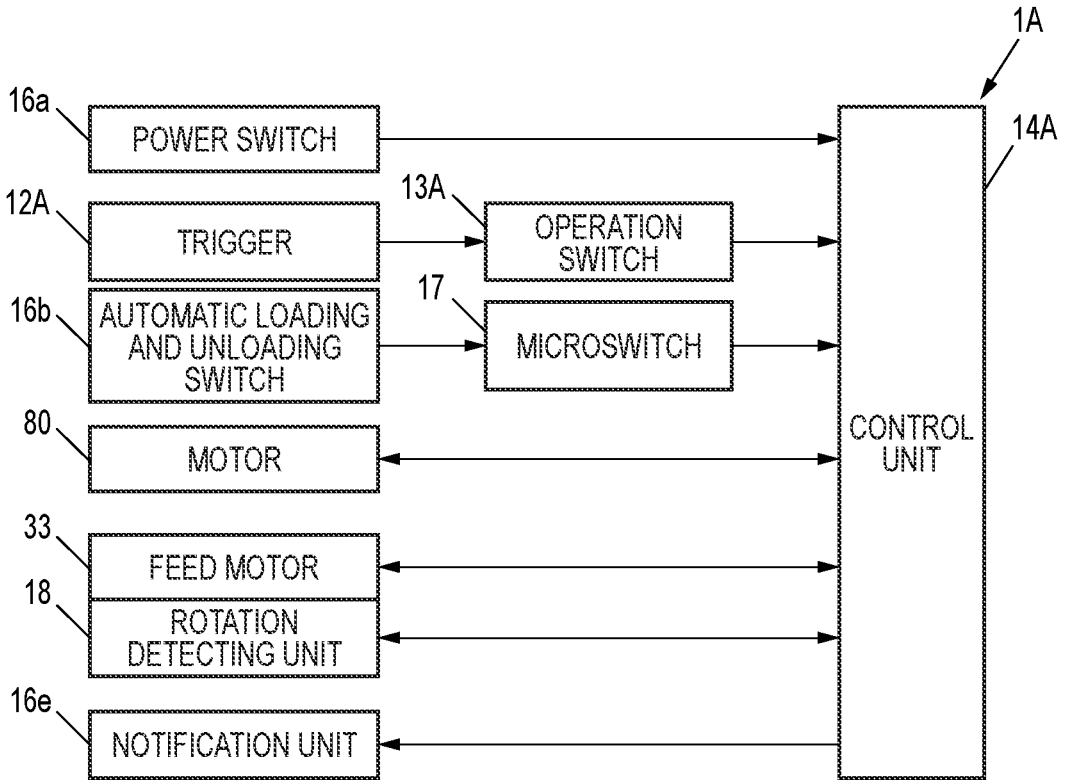
FIG. 5 is a block diagram showing an example of a control function of the reinforcing bar binding machine.

FIG. 5 is a block diagram showing an example of a control function of the reinforcing bar binding machine. The reinforcing bar binding machine 1A performs a series of operations including the control unit 14A controlling the motor 80 and the feed motor 33 to bind the reinforcing bars S with the wire W according to a state of the operation switch 13A pressed by operating the trigger 12A shown in FIGS. 1A and 1B. In addition, the control unit 14A switches power on and off by operating the power switch 16*a*. Further, the control unit 14A controls the feed motor 33 based on an output of a microswitch 17 by operating the automatic loading and unloading switch 16*b* to load and unload the wire W by the wire feeding unit 3A. The automatic loading and unloading switch 16*b* is a push-button type switch in this example, and is configured to actuate the microswitch 17 when pressed.

The feed motor 33 is formed of a brushless motor in this example, and includes a rotation detecting unit 18 such as a Hall IC for detecting a rotation position of a rotor. In the wire feeding unit 3A, the driving force transmission mechanism 34 for transmitting the driving force of the feed motor 33 to the first feed gear 30L includes a spur gear. Accordingly, when the tip of the wire W is inserted between the groove portion 32L of the first feed gear 30L and the groove portion 32R of the second feed gear 30R and the wire W is pushed, in a state in which the feed motor 33 is not rotating due to energization, a behavior (rotation) of the first feed gear 30L and the second feed gear 30R allows the feed motor 33 to be rotated by an external force. That is, the rotation detecting unit 18 is included in a detection unit that detects a movement due to the behavior of the first feed gear 30L and the second feed gear 30R.

When the microswitch 17 is pressed by operating the automatic loading and unloading switch 16*b*, the control unit 14A executes the automatic loading and unloading mode in which an automatic unloading operation and an automatic loading operation of the wire W are executed. When the automatic loading and unloading mode is executed, the control unit 14A may notify, by a notification unit 16*e*, that the automatic loading and unloading mode is being executed. The notification unit 16*e* may be a buzzer that outputs sound, or a lamp or a display that outputs visible information such as light or display. In addition, when the power switch 16*a* is operated and the power is turned on, the control unit 14A may notify, by the notification unit 16*e*, that the power is on (the power is ON) and the reinforcing bar binding machine 1A is in a binding standby state.

When the automatic loading and unloading mode is executed, the control unit 14A firstly executes the automatic unloading operation to unload the wire W remaining in the reinforcing bar binding machine 1A. In the automatic unloading operation, the feed motor 33 is rotated in the backward direction, and when the feed motor 33 is rotated in the backward direction by a defined amount of rotation for the unloading operation in which the wire W is came off from between the first feed gear 30L and the second feed gear 30R, the feed motor 33 is stopped.

In addition, when the automatic loading and unloading mode is executed and the wire W remaining in the reinforcing bar binding machine 1A is unloaded, the control unit 14A executes the automatic loading operation to load a new wire W into the reinforcing bar binding machine 1A. In the automatic loading operation, when the rotation detecting unit 18 detects that the feed motor 33 has rotated in the state in which the feed motor 33 is not rotating due to energization, the control unit 14A drives the feed motor 33 in a forward rotation direction to feed the wire W in the forward direction. When the feed motor 33 is driven in the forward rotation direction by a defined amount of rotation for the loading operation in which the wire W is forwarded by a predetermined amount from a position where the first feed gear 30L and the second feed gear 30R mesh, the feed motor 33 is stopped.

When a defined time when the automatic loading and unloading mode times out elapses before the automatic loading operation is performed, the control unit 14A ends the automatic loading and unloading mode, and even if the rotation detecting unit 18 detects that the feed motor 33 has rotated in the state in which the feed motor 33 is not rotating due to energization, the control unit 14A does not perform the loading operation described above.

In addition, when the automatic loading and unloading switch 16*b* is pressed (first operation), and the automatic loading and unloading switch 16*b* is pressed again (second operation) after the automatic loading and unloading mode is started and before the defined time when the automatic loading and unloading mode times out elapses, the control unit 14A ends the automatic loading and unloading mode, and even if the rotation detecting unit 18 detects that the feed motor 33 has rotated in the state in which the feed motor 33 is not rotating due to energization, the control unit 14A does not perform the loading operation described above.

In the automatic loading operation, when the rotation detecting unit 18 detects that the feed motor 33 has rotated in the state in which the feed motor 33 is not rotating due to energization, the control unit 14A changes a state between a first state and a second state to feed the wire W in the forward direction.

The control unit 14A controls whether the feed motor 33 is driven in the forward rotation direction and a rotation speed between the first state and the second state. Presence or absence of output of the notification information from the notification unit 16*e* may be combined. The first state is a state in which the notification unit 16*e* gives a predetermined notification. In addition, the first state is a state in which the feed motor 33 is stopped, or a state in which the feed motor 33 is rotated in the forward direction at a first rotation speed lower than a second rotation speed. Further, the first state may be a combination of the state in which the notification unit 16*e* gives a predetermined notification and the state in which the feed motor 33 is stopped.

<Example of Binding Operation of Reinforcing Bar Binding Machine>

Next, an operation of binding the reinforcing bars S with the wire W by the reinforcing bar binding machine 1A will be described with reference to each figure.

In the reinforcing bar binding machine 1A, the wire W is clamped between the first feed gear 30L and the second feed gear 30R, and a state in which the tip of the wire W is positioned between the clamping position of the pair of feed gears 30 and the cutting unit 6A is a standby state (standby position). In addition, in the standby state, as shown in FIGS. 4A and 4B, the reinforcing bar binding machine 1A is in a state in which the first side hook 70R is opened with respect to the center hook 70C and the second side hook 70L is opened with respect to the center hook 70C.

When the reinforcing bars S are inserted between the curl guide 50 and the leading guide 51 of the curl forming unit 5A and the trigger 12A is operated, the control unit 14A drives the feed motor 33 in the forward rotation direction, which is the first rotation direction, so that the wire feeding unit 3A feeds the wire W in the forward direction indicated by the arrow F, which is the first direction.

In a case of feeding a plurality of wires W, for example, two wires W, the two wires W are fed by the wire guide 4A in a state of being arranged in parallel along an axial direction of the loop Ru formed by the wires W.

The wire W fed in the forward direction passes between the center hook 70C and the first side hook 70R and is fed to the curl guide 50 of the curl forming unit 5A. The wire W is curled to be wound around the reinforcing bars S by passing through the curl guide 50.

The wire W curled by the curl guide 50 is lead by the leading guide 51 and further fed in the forward direction by the wire feeding unit 3A, so that the wire W is lead between the center hook 70C and the second side hook 70L by the leading guide 51. Then, the wire W is fed until the tip thereof abuts against the feed regulating unit 90. When the tip of the wire W is fed to a position where the tip abuts against the feed regulating unit 90, the control unit 14A stops driving the feed motor 33.

After the feed of the wire W in the forward direction is stopped, the control unit 14A drives the motor 80 in the forward rotation direction. In an operating range where the wire W is locked by the wire locking body 70, the rotation of the sleeve 71 interlocked with the rotation of the rotation shaft 72 is regulated by locking the rotation regulating blade 74*a* to the rotation regulating pawl 74*b*. Accordingly, rotation of the motor 80 is converted into a linear movement, and the sleeve 71 moves in the direction indicated by the arrow A1 which is a forward direction.

When the sleeve 71 moves in the forward direction, the opening and closing pin 71*a* passes through the opening and closing guide hole 73. Accordingly, the first side hook 70R moves in a direction approaching the center hook 70C by the rotation operation with the shaft 71*b* as a fulcrum. When the first side hook 70R is closed with respect to the center hook 70C, the wire W sandwiched between the first side hook 70R and the center hook 70C is locked in a form of capable of moving between the first side hook 70R and the center hook 70C.

In addition, the second side hook 70L moves in a direction approaching the center hook 70C by the rotation operation with the shaft 71*b* as a fulcrum. When the second side hook 70L is closed with respect to the center hook 70C, the wire W sandwiched between the second side hook 70L and the center hook 70C is locked in a form of not coming off from between the second side hook 70L and the center hook 70C.

After the sleeve 71 is advanced to a position where the wire W is locked by an operation of closing the first side hook 70R and the second side hook 70L, the control unit 14A temporarily stops the rotation of the motor 80 and drives the feed motor 33 in a backward rotation direction, which is the second rotation direction opposite to the first rotation direction. Accordingly, the pair of feed gears 30 are rotated in the backward direction.

Therefore, the wire W clamped between the pair of feed gears 30 is fed in the backward direction indicated by the arrow R, which is the second direction. Since the tip side of the wire W is locked in the form of not coming off from between the second side hook 70L and the center hook 70C, the wire W is wound around the reinforcing bars S by the operation of feeding the wire W in the backward direction.

The wire W is pulled back to a position where the wire W is wound around the reinforcing bars S, and after the driving of the feed motor 33 in the backward rotation direction is stopped, the control unit 14A drives the motor 80 in the forward rotation direction to move the sleeve 71 in the forward direction indicated by the arrow A1. The operation of the sleeve 71 moving in the forward direction is transmitted to the cutting unit 6A by the transmission mechanism 62, thereby cutting the wire W locked by the first side hook 70R and the center hook 70C.

The bending units 71*cl* and 71*c*2 move in a direction approaching the reinforcing bars S at substantially the same time as the wire W is cut. Accordingly, the tip side of the wire W locked by the center hook 70C and the second side hook 70L is pressed toward the reinforcing bars S by the bending unit 71*c*1, and bent toward the reinforcing bars S with the locking position as a fulcrum. By further moving the sleeve 71 in the forward direction, the wire W locked between the second side hook 70L and the center hook 70C is held in a state of being sandwiched by the bending unit 71*c*1.

In addition, the terminal side of the wire W locked by the center hook 70C and the first side hook 70R and cut by the cutting unit 6A is pressed toward the reinforcing bars S by the bending unit 71*c*2, and bent toward the reinforcing bars S with the locking position as a fulcrum. By further moving the sleeve 71 in the forward direction, the wire W locked between the first side hook 70R and the center hook 70C is held in a state of being sandwiched by the bending unit 71*c*2.

After the tip side and the terminal side of the wire W are bent toward the reinforcing bars S, the sleeve 71 further moves in the forward direction by further driving the motor 80 in the forward rotation direction. When the sleeve 71 moves to a predetermined position and reaches an operating range where the wire W locked by the wire locking body 70 is twisted, the locking of the rotation regulating blade 74*a* to the rotation regulating pawl 74*b* is released.

Accordingly, when the motor 80 is further driven in the forward rotation direction, the wire locking body 70 rotates in conjunction with the rotation shaft 72, and the wire W is twisted.

In an operating range where the sleeve 71 rotates, the reinforcing bars S abut against the abutting portion 91, and a movement in a backward direction which is a direction in which the reinforcing bars S approach the binding unit 7A is regulated, and therefore, the binding unit 7A twists the wire W to apply a force for pulling the wire locking body 70 forward along the axial direction of the rotation shaft 72.

The rotation shaft 72 is configured to, when a force for moving the wire locking body 70 forward along the axial direction is applied to the wire locking body 70, be movable forward while receiving a backward pushing force from the spring 72*c*. Accordingly, the binding unit 7A twists the wire W while the wire locking body 70 and the rotation shaft 72 move forward in the operating range where the sleeve 71 rotates.

<Operation Example of Automatic Loading and Unloading Mode of Wire>

Figure 6:
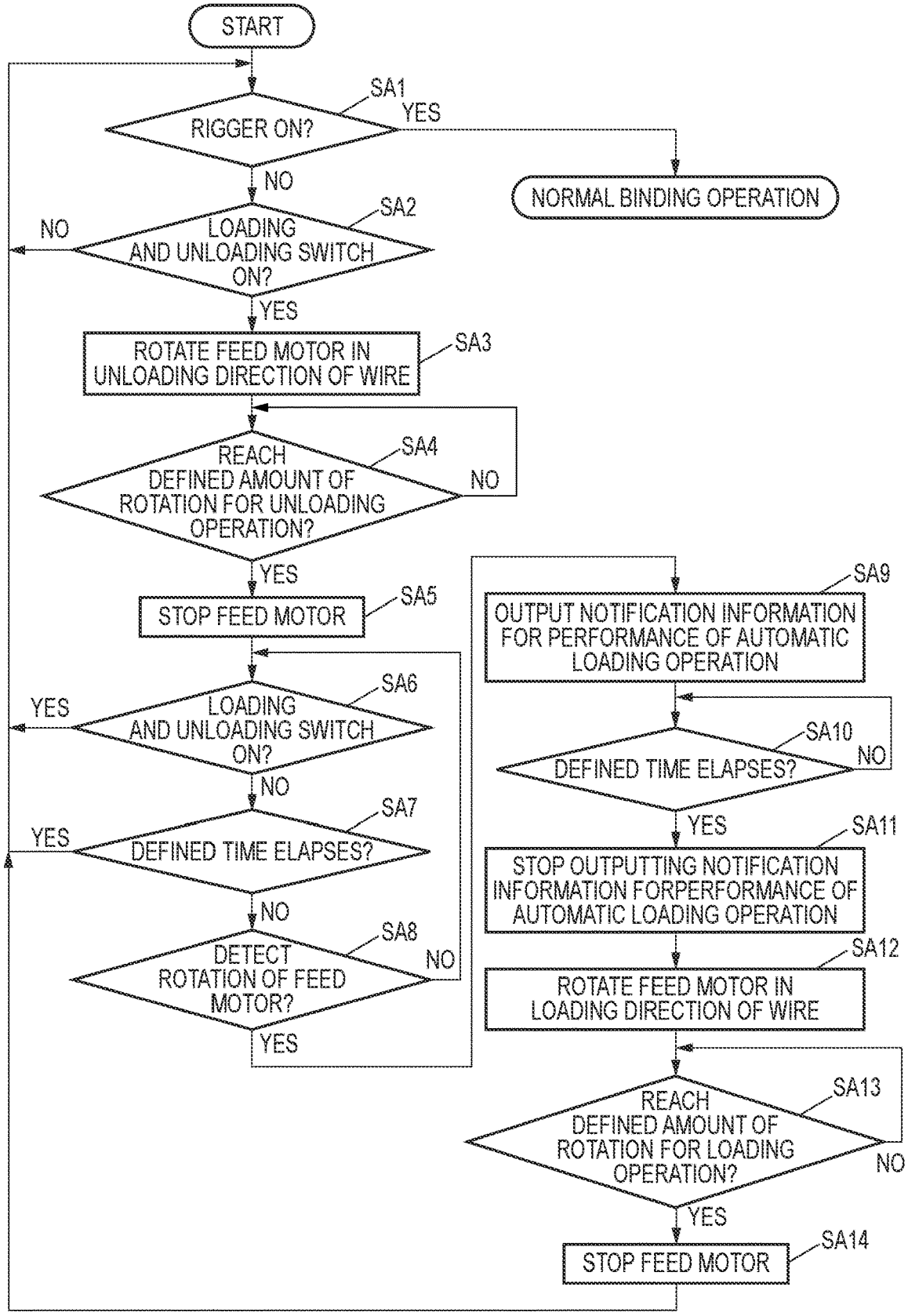
FIG. 6 is a flowchart showing an example of operations in an automatic loading and unloading mode.
Figure 7:
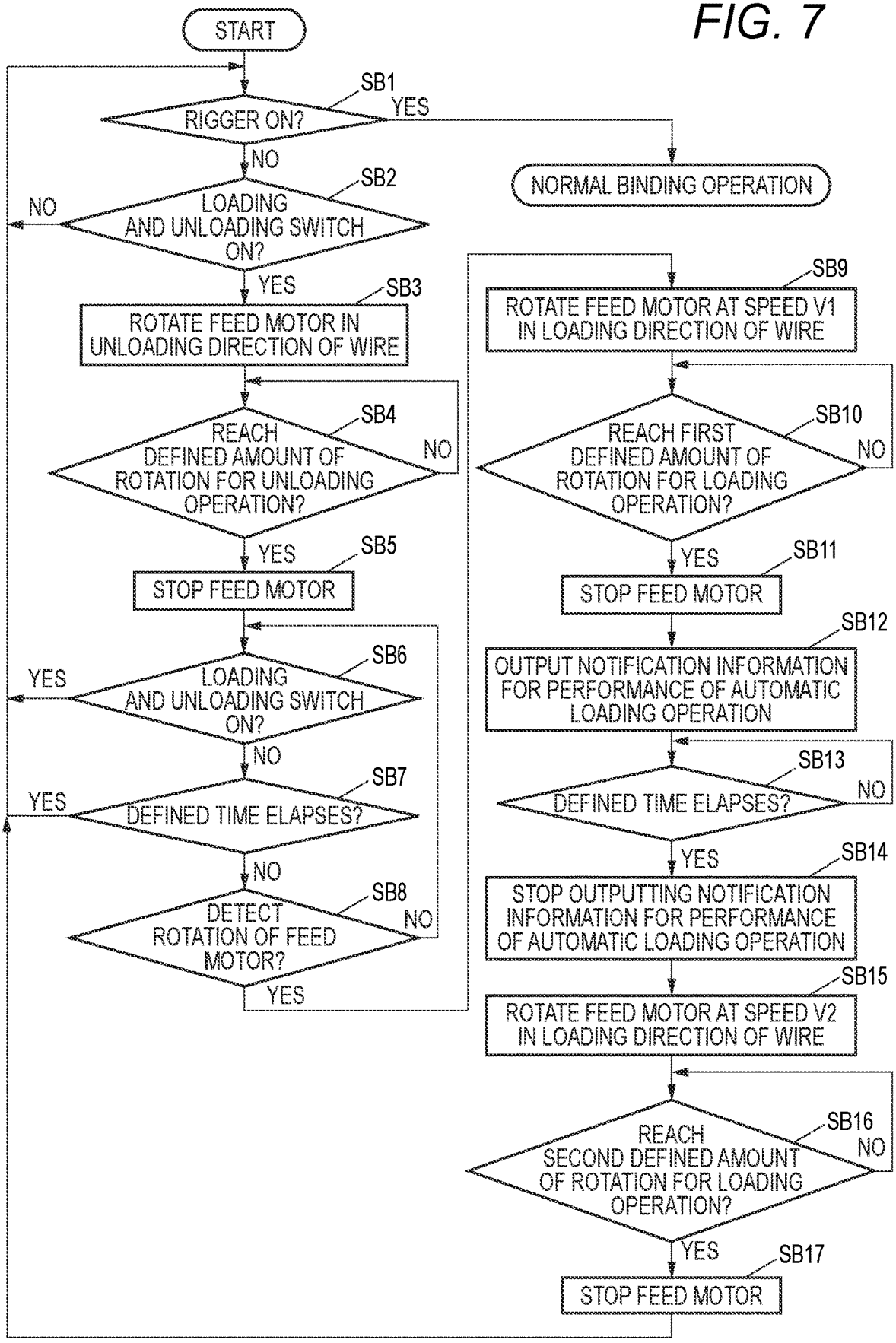
FIG. 7 is a flowchart showing an example of operations in an automatic loading and unloading mode.
Figure 8:
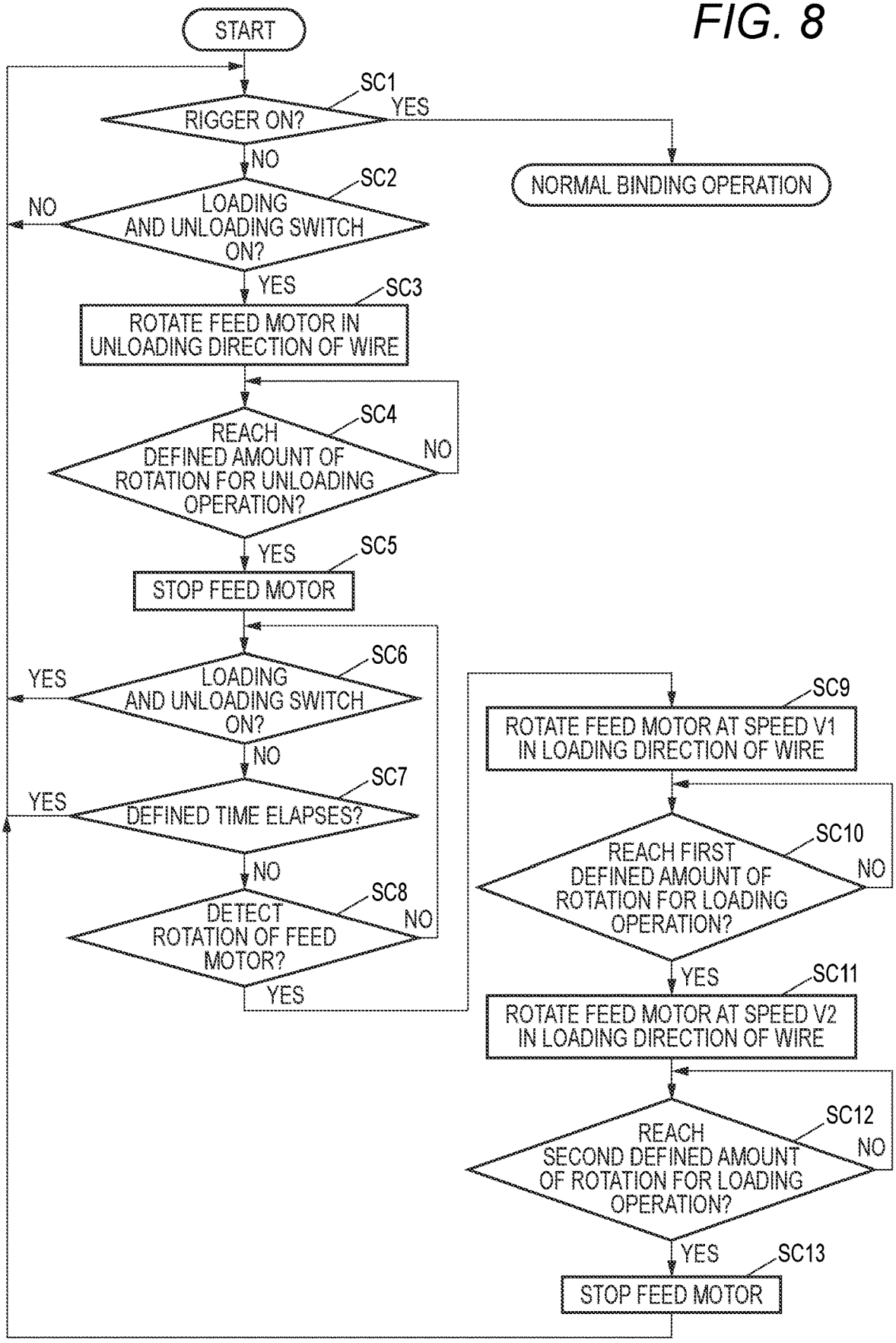
FIG. 8 is a flowchart showing an example of operations in an automatic loading and unloading mode.

FIGS. 6, 7 and 8 each is a flowchart showing an example of operations in the automatic loading and unloading mode. Next, operations of automatically unloading and loading the wire W by the reinforcing bar binding machine 1A will be described.

In the reinforcing bar binding machine 1A, in this example, a combination of a predetermined operation of the trigger 12A and a predetermined operation of the automatic loading and unloading switch 16*b* is assigned to execute the automatic loading and unloading mode of the wire W. In the following example, the automatic loading and unloading mode is set to start when the automatic loading and unloading switch 16*b* is operated without operating the trigger 12A.

First, the automatic loading and unloading mode shown in FIG. 6 will be described. The control unit 14A determines whether the trigger 12A is operated at step SA1 in FIG. 6, and determines whether the automatic loading and unloading switch 16*b* is operated at step SA2. In the following description, a matter that the trigger 12A is operated is also referred to as trigger ON, and a matter that the automatic loading and unloading switch 16*b* is operated is also referred to as loading and unloading switch ON.

When the trigger 12A is operated, the control unit 14A performs the binding operation described above.

When the automatic loading and unloading switch 16*b* is operated with the trigger 12A not operated in a state in which the automatic loading and unloading mode is not executed, the control unit 14A determines that an operation of executing the automatic loading and unloading mode is performed. When the control unit 14A determines that the operation of starting the automatic loading and unloading mode is performed, the control unit 14A firstly performs the automatic unloading operation in the automatic loading and unloading mode. In the automatic unloading operation, at step SA3 in FIG. 6, the feed motor 33 is driven in the backward rotation direction, which is an unloading direction of the wire W.

When the wire W is fed in the backward direction, which is the unloading direction, by driving the feed motor 33 in the backward rotation direction, the tip of the wire W clamped between the first feed gear 30L and the second feed gear 30R comes off from between the first feed gear 30L and the second feed gear 30R, and the wire W is separated from the first feed gear 30L and the second feed gear 30R.

At step SA4 in FIG. 6, when an amount of rotation of the feed motor 33 in the backward rotation direction reaches the defined amount of rotation for the unloading operation in which the wire W is came off from between the first feed gear 30L and the second feed gear 30R, the control unit 14A stops the rotation of the feed motor 33 in the backward rotation direction at step SA5.

It should be noted that when the wire W is fed in the backward direction by driving the feed motor 33 in the backward rotation direction, and the tip of the wire W clamped between the first feed gear 30L and the second feed gear 30R comes off from between the first feed gear 30L and the second feed gear 30R, a load applied to the feed motor 33 is reduced, and a value of a current flowing through the feed motor 33 is reduced.

Therefore, the control unit 14A may compare the value of the current flowing through the feed motor 33 with a predetermined set threshold for detecting absence of the wire W between the first feed gear 30L and the second feed gear 30R, and determine whether the wire W is came off from between the first feed gear 30L and the second feed gear 30R.

In addition, in the automatic loading and unloading mode described above, an operation of driving the cutting unit 6A to cut the wire W and an operation of returning the binding unit 7A to the standby state may be performed before the wire W is fed in the backward direction in the automatic unloading operation. For example, when the control unit 14A determines that the operation of starting the automatic loading and unloading mode described above is performed, the control unit 14A drives the motor 80 in the forward rotation direction to move the sleeve 71 in the forward direction indicated by the arrow A1 to perform the wire cutting operation by the cutting unit 6A. When the wire W is in a position where the wire W can be cut by the cutting unit 6A, the wire W is cut, and the wire W on the binding unit 7A side from the cutting unit 6A and the wire W on the wire feeding unit 3A side from the cutting unit 6A are separated.

After the motor 80 is driven in the forward rotation direction by a predetermined amount, the control unit 14A drives the motor 80 in the backward rotation direction to move the sleeve 71 in the rearward direction indicated by the arrow A2 to return the binding unit 7A to the standby state described above. When the operation of actuating the cutting unit 6A and the operation of returning the binding unit 7A to the standby state described above are performed, the control unit 14A drives the feed motor 33 in the backward rotation direction to perform the automatic unloading operation at step SA3 described above.

The control unit 14A unloads the wire W from between the first feed gear 30L and the second feed gear 30R in the automatic unloading operation during execution of the automatic loading and unloading mode and stops driving the feed motor 33, and then performs the automatic loading operation by a predetermined operation. In this example, when a next wire W is inserted into a position where the wire W can be fed in the forward direction by the first feed gear 30L and the second feed gear 30R, the automatic loading operation is started.

However, before the automatic loading operation is performed, the control unit 14A determines whether a predetermined state for ending the automatic loading and unloading mode is reached. That is, the control unit 14A determines at step SA6 whether the automatic loading and unloading switch 16*b* is operated again during execution of the automatic loading and unloading mode after the automatic unloading operations from steps SA1 to SA5 in FIG. 6 described above are performed, and determines at step SA7 whether a defined time for ending the automatic loading and unloading mode elapses after the automatic unloading operation is performed.

When the control unit 14A determines at step SA6 that the automatic loading and unloading switch 16*b* is operated again during execution of the automatic loading and unloading mode, the control unit 14A ends the automatic loading and unloading mode and does not perform the following automatic loading operations. That is, when the automatic loading and unloading switch 16*b* is operated again after the wire W is unloaded from between the first feed gear 30L and the second feed gear 30R and before a next wire W is inserted into a position where the wire W can be fed in the forward direction by the first feed gear 30L and the second feed gear 30R, the automatic loading and unloading mode is ended.

In addition, when the control unit 14A determines at step SA7 that the defined time for ending the automatic loading and unloading mode elapses with a predetermined operation of starting the automatic loading operation not performed after the automatic unloading operation is performed, the control unit 14A ends the automatic loading and unloading mode and does not perform the following automatic loading operations. That is, after the wire W is unloaded from between the first feed gear 30L and the second feed gear 30R, even if the automatic loading and unloading switch 16*b* is not operated again, when the defined time elapses before the wire W is inserted into the position where the wire W can be fed in the forward direction by the first feed gear 30L and the second feed gear 30R, the automatic loading and unloading mode is ended.

After the automatic unloading operation of the wire W is performed, the automatic loading and unloading switch 16*b* is not operated, and before the defined time for ending the automatic loading and unloading mode elapses, when the wire W is inserted into the position where the wire W can be fed in the forward direction by the first feed gear 30L and the second feed gear 30R in an insertion standby state in which the wire W is separated from the first feed gear 30L and the second feed gear 30R, the control unit 14A performs the automatic loading operation in the automatic loading and unloading mode.

In order to start the automatic loading operation of the wire W, by the operation of inserting the wire W between the first feed gear 30L and the second feed gear 30R by the user of the reinforcing bar binding machine 1A, the first feed gear 30L and the second feed gear 30R rotate, and the feed motor 33 connected to the first feed gear 30L via the driving force transmission mechanism 34 rotates. Therefore, since the control unit 14A detects that the wire W is inserted into the position where the wire W can be fed in the forward direction by the first feed gear 30L and the second feed gear 30R, the control unit 14A determines, at step SA8 in FIG. 6 and by the rotation detecting unit 18, whether the feed motor 33 is rotated in the forward rotation direction without driving the control unit 14A. It should be noted that the control unit 14A may determine, by detecting a position of the wire W by a sensor (not shown), that the wire W is inserted into the position where the wire W can be fed in the forward direction by the first feed gear 30L and the second feed gear 30R.

After the automatic unloading operation of the wire W is performed, the automatic loading and unloading switch 16*b* is not operated, and before the defined time for ending the automatic loading and unloading mode elapses, when the control unit 14A determines, by the rotation detecting unit 18, that the feed motor 33 is rotated in the forward rotation direction without driving the control unit 14A, the control unit 14A drives, at step SA9 in FIG. 6, the notification unit 16*e* to sound a buzzer to start outputting notification information for performance of the automatic loading operation, which is notification information to notify performance of the automatic loading operation, as the first state.

When the control unit 14A determines at step SA10 in FIG. 6 that the notification information for performance of the automatic loading operation is output for a predetermined time, the control unit 14A stops outputting the notification information for performance of the automatic loading operation at step SA11. The control unit 14A does not drive the feed motor 33 and makes the feed motor 33 not rotate while outputting the notification information for performance of the automatic loading operation as the first state. Accordingly, the wire W is not fed in the forward direction while the notification information for performance of the automatic loading operation is being output, which is the wire feed standby time.

When the control unit 14A ends the output of the notification information for performance of the automatic loading operation, the control unit 14A drives, at step SA12 in FIG. 6, the feed motor 33 in the forward rotation direction, which is a loading direction of the wire W, as the second state. When the feed motor 33 is driven in the forward rotation direction, the wire W is fed in the forward direction, which is the loading direction.

The control unit 14A determines whether an amount of rotation of the feed motor 33 reaches a defined amount of rotation at which the wire W is forwarded by a predetermined amount from the position where the first feed gear 30L and the second feed gear 30R mesh. When the control unit 14A determines at step SA13 in FIG. 6 that an amount of rotation of the feed motor 33 in the forward direction reaches the defined amount of rotation for the loading operation, the control unit 14A stops the rotation of the feed motor 33 in the forward rotation direction at step SA14.

It should be noted that after the driving of the feed motor 33 is stopped and the feeding of the wire W in the forward direction is stopped, a so-called initializing operation may be performed to position the tip of the wire W at a predetermined position.

That is, it is determined, based on the amount of rotation of the feed motor 33, etc., whether the tip of the wire W fed in the forward direction passes through the cutting unit 6A and the tip of the wire W is fed to a position where the wire W can be cut by the cutting unit 6A. When the control unit 14A determines that a feed amount of the wire W reaches a predetermined amount and the tip of the wire W is fed to the position where the wire W can be cut by the cutting unit 6A, the control unit 14A stops driving the feed motor 33.

Next, the control unit 14A drives the motor 80 in the forward rotation direction to move the sleeve 71 in the forward direction as indicated by the arrow A1 to cut the wire W by the cutting unit 6A. Then, the control unit 14A drives the motor 80 in the backward rotation direction to move the sleeve 71 in the rearward direction indicated by the arrow A2 to make the binding unit 7A be in the standby state described above. Accordingly, the wire W is clamped between the first feed gear 30L and the second feed gear 30R, and the tip of the wire W is in a standby position positioned between the clamping position of the pair of feed gears 30 and the cutting unit 6A.

It should be noted that the automatic loading operation may be an independent operation rather than a continuous operation from the automatic unloading operation. In this case, when the trigger 12A is not operated and the automatic loading and unloading switch 16*b* is operated, it is determined that an operation of performing the automatic loading operation is performed, and the automatic loading operation is performed by the processes from step SA8 described above.

In the automatic loading and unloading mode described in FIG. 6, when it is determined, by detecting that the feed motor 33 is rotated in the forward rotation direction without driving the control unit 14A, that the operation of inserting the wire W between the first feed gear 30L and the second feed gear 30R by the user of the reinforcing bar binding machine 1A is performed, the output of the notification information for performance of the automatic loading operation is started as the first state. The feed motor 33 is not driven and is not rotated while the notification information for performance of the automatic loading operation is being output. Then, when the output of the notification information for performance of the automatic loading operation is ended, the feed motor 33 is driven in the forward rotation direction, which is the loading direction of the wire W, as the second state.

Accordingly, a matter that by the operation of inserting the wire W between the first feed gear 30L and the second feed gear 30R by the user of the reinforcing bar binding machine 1A, the wire W is fed in the forward direction by driving the feed motor 33 can be recognized based on the notification information for performance of the automatic loading operation.

Next, the automatic loading and unloading mode shown in FIG. 7 will be described. Automatic unloading operations from step SB1 to step SB5 in FIG. 7 are the same as the automatic unloading operations from step SA1 to step SA5 in FIG. 6 described above. That is, at steps SB1 and SB2, when the automatic loading and unloading switch 16*b* is operated with the trigger 12A not operated in a state in which the automatic loading and unloading mode is not executed, it is determined that an operation of executing the automatic loading and unloading mode is performed.

When the control unit 14A determines that the operation of executing the automatic loading and unloading mode is performed, the control unit 14A firstly performs the automatic unloading operation in the automatic loading and unloading mode. In the automatic unloading operation, at steps SB3, SB4 and SB5 in FIG. 7, when the feed motor 33 is driven in the backward rotation direction, which is the unloading direction of the wire W, and the amount of rotation of the feed motor 33 in the backward rotation direction reaches the defined amount of rotation for the unloading operation, the rotation of the feed motor 33 in the backward rotation direction is stopped.

The control unit 14A determines at step SB6 whether the automatic loading and unloading switch 16*b* is operated again after the automatic unloading operations from steps SB1 to SB5 in FIG. 7 described above are performed, and determines at step SB7 whether a defined time elapses after the automatic unloading operation is performed.

When the control unit 14A determines at step SB6 that the automatic loading and unloading switch 16*b* is operated again, the control unit 14A ends the automatic loading and unloading mode and does not perform the following automatic loading operations. In addition, when the control unit 14A determines at step SB7 that the defined time elapses, the control unit 14A ends the automatic loading and unloading mode and does not perform the following automatic loading operations.

After the automatic unloading operation of the wire W is performed, the automatic loading and unloading switch 16*b* is not operated, and before the defined time for ending the automatic loading and unloading mode elapses, when the wire W is inserted into the position where the wire W can be fed in the forward direction by the first feed gear 30L and the second feed gear 30R, the control unit 14A performs the automatic loading operation in the automatic loading and unloading mode.

That is, when the control unit 14A determines at step SB8 in FIG. 7 that the feed motor 33 is rotated in the forward rotation direction without driving the control unit 14A, the control unit 14A drives, at step SB9, the feed motor 33 at a first rotation speed V1 in the forward rotation direction, which is the loading direction of the wire W, as the first state. When the feed motor 33 is driven in the forward rotation direction, the wire W is fed in the forward direction, which is the loading direction. The first rotation speed V1 is lower than a second rotation speed V2, which is a rotation speed for feeding the wire W in the forward direction in the binding operation described above or a rotation speed for feeding the tip of the wire W to the standby position.

The control unit 14A determines whether an amount of rotation of the feed motor 33 reaches a first defined amount of rotation at which the wire W is forwarded by a first predetermined amount from the position where the first feed gear 30L and the second feed gear 30R mesh. When the control unit 14A determines at step SB10 in FIG. 7 that an amount of rotation of the feed motor 33 in the forward direction reaches the first defined amount of rotation for the loading operation, the control unit 14A stops the rotation of the feed motor 33 in the forward rotation direction at step SB11.

When the control unit 14A stops the rotation of the feed motor 33 at the first rotation speed V1, the control unit 14A starts outputting the notification information for performance of the automatic loading operation at step SB12 in FIG. 7, as the first state. When the control unit 14A determines at step SB13 in FIG. 7 that the notification information for performance of the automatic loading operation is output for a predetermined time, the control unit 14A stops outputting the notification information for performance of the automatic loading operation at step SB14. The control unit 14A does not drive the feed motor 33 and makes the feed motor 33 not rotate while outputting the notification information for performance of the automatic loading operation. Accordingly, the wire W is not fed in the forward direction while the notification information for performance of the automatic loading operation is being output.

When the control unit 14A ends the output of the notification information for performance of the automatic loading operation, the control unit 14A drives, at step SB15 in FIG. 7, the feed motor 33 at the second rotation speed V2 in the forward rotation direction, which is a loading direction of the wire W, as the second state. When the feed motor 33 is driven in the forward rotation direction, the wire W is fed in the forward direction, which is the loading direction.

The control unit 14A determines whether the amount of rotation of the feed motor 33 reaches a second defined amount of rotation at which the wire W forwarded by the first predetermined amount from the position where the first feed gear 30L and the second feed gear 30R mesh is further fed by a second predetermined amount. When the control unit 14A determines at step SB16 in FIG. 7 that the amount of rotation of the feed motor 33 in the forward direction reaches the second defined amount of rotation for the loading operation, the control unit 14A stops the rotation of the feed motor 33 in the forward rotation direction at step SB17.

It should be noted that after the output of the notification information for performance of the automatic loading operation is ended, at step SB15 in FIG. 7, the feed motor 33 is driven at the second rotation speed V2 in the forward rotation direction, which is the loading direction of the wire W, and when it is determined that the amount of rotation of the feed motor 33 in the forward direction at the second rotation speed V2 reaches the second defined amount of rotation for the loading operation, the rotation of the feed motor 33 in the forward rotation direction may be stopped. In addition, after the driving of the feed motor 33 is stopped and the feeding of the wire W in the forward direction is stopped, a so-called initializing operation may be performed to position the tip of the wire W at a predetermined position.

In addition, the automatic loading operation may be an independent operation rather than a continuous operation from the automatic unloading operation. In this case, when the trigger 12A is not operated and the automatic loading and unloading switch 16*b* is operated, it is determined that an operation of performing the automatic loading operation is performed, and the automatic loading operation is performed by the processes from step SB8 described above.

In the automatic loading and unloading mode described in FIG. 7, when it is determined, by detecting that the feed motor 33 is rotated in the forward rotation direction without driving the control unit 14A, that the operation of inserting the wire W between the first feed gear 30L and the second feed gear 30R by the user of the reinforcing bar binding machine 1A is performed, the feed motor 33 is driven at the first rotation speed V1 in the forward rotation direction, which is the loading direction of the wire W, as the first state. The first rotation speed V1 is lower than the second rotation speed V2, which is a rotation speed for feeding the wire W in the forward direction in the binding operation described above or a rotation speed for feeding the tip of the wire W to the standby position.

When it is determined that the amount of rotation of the feed motor 33 in the forward direction at the first rotation speed V1 reaches the first defined amount of rotation for the loading operation, the rotation of the feed motor 33 in the forward rotation direction is stopped, and the output of the notification information for performance of the automatic loading operation is started. The feed motor 33 is not driven and is not rotated while the notification information for performance of the automatic loading operation is being output. Then, when the output of the notification information for performance of the automatic loading operation is ended, the feed motor 33 is driven at the second rotation speed V2 or the first rotation speed V1 in the forward rotation direction, which is the loading direction of the wire W, as the second state.

Accordingly, a matter that by the operation of inserting the wire W between the first feed gear 30L and the second feed gear 30R by the user of the reinforcing bar binding machine 1A, the wire W is fed in the forward direction by driving the feed motor 33 can be recognized based on the notification information for performance of the automatic loading operation and a fact of feeding the wire W in the forward direction by rotating the feed motor 33 in the forward direction at the first rotation speed V1.

Next, the automatic loading and unloading mode shown in FIG. 8 will be described. Automatic unloading operations from step SC1 to step SC5 in FIG. 8 are the same as the automatic unloading operations from step SA1 to step SA5 in FIG. 6 described above. That is, at steps SC1 and SC2, when the automatic loading and unloading switch 16*b* is operated with the trigger 12A not operated in a state in which the automatic loading and unloading mode is not executed, it is determined that an operation of executing the automatic loading and unloading mode is performed.

When the control unit 14A determines that the operation of executing the automatic loading and unloading mode is performed, the control unit 14A firstly performs the automatic unloading operation in the automatic loading and unloading mode. In the automatic unloading operation, at steps SC3, SC4 and SC5 in FIG. 8, when the feed motor 33 is driven in the backward rotation direction, which is the unloading direction of the wire W, and the amount of rotation of the feed motor 33 in the backward rotation direction reaches the defined amount of rotation for the unloading operation, the rotation of the feed motor 33 in the backward rotation direction is stopped.

The control unit 14A determines at step SC6 whether the automatic loading and unloading switch 16*b* is operated again after the automatic unloading operations from steps SC1 to SC5 in FIG. 8 described above are performed, and determines at step SC7 whether a defined time elapses after the automatic unloading operation is performed.

When the control unit 14A determines at step SC6 that the automatic loading and unloading switch 16*b* is operated again, the control unit 14A ends the automatic loading and unloading mode and does not perform the following automatic loading operations. In addition, when the control unit 14A determines at step SC7 that the defined time elapses, the control unit 14A ends the automatic loading and unloading mode and does not perform the following automatic loading operations.

After the automatic unloading operation of the wire W is performed, the automatic loading and unloading switch 16*b* is not operated, and before the defined time for ending the automatic loading and unloading mode elapses, when the wire W is inserted into the position where the wire W can be fed in the forward direction by the first feed gear 30L and the second feed gear 30R, the control unit 14A performs the automatic loading operation in the automatic loading and unloading mode.

That is, when the control unit 14A determines at step SC8 in FIG. 8 that the feed motor 33 is rotated in the forward rotation direction without driving the control unit 14A, the control unit 14A drives, at step SC9, the feed motor 33 at the first rotation speed V1 in the forward rotation direction, which is the loading direction of the wire W, as the first state. When the feed motor 33 is driven in the forward rotation direction, the wire W is fed in the forward direction, which is the loading direction. The first rotation speed V1 is lower than the second rotation speed V2, which is a rotation speed for feeding the wire W in the forward direction in the binding operation described above or a rotation speed for feeding the tip of the wire W to the standby position.

The control unit 14A determines whether an amount of rotation of the feed motor 33 reaches a first defined amount of rotation at which the wire W is forwarded by a first predetermined amount from the position where the first feed gear 30L and the second feed gear 30R mesh. When the control unit 14A determines at step SC10 in FIG. 8 that the amount of rotation of the feed motor 33 in the forward direction reaches the first defined amount of rotation for the loading operation, the control unit 14A drives, at step SC11 in FIG. 8, the feed motor 33 at the second rotation speed V2 in the forward rotation direction, which is the loading direction of the wire W, as the second state.

The control unit 14A determines whether the amount of rotation of the feed motor 33 reaches a second defined amount of rotation at which the wire W forwarded by the first predetermined amount from the position where the first feed gear 30L and the second feed gear 30R mesh is further fed by a second predetermined amount. When the control unit 14A determines at step SC12 in FIG. 8 that the amount of rotation of the feed motor 33 in the forward direction reaches the second defined amount of rotation for the loading operation, the control unit 14A stops the rotation of the feed motor 33 in the forward rotation direction at step SC13.

It should be noted that after the driving of the feed motor 33 is stopped and the feeding of the wire W in the forward direction is stopped, a so-called initializing operation may be performed to position the tip of the wire W at a predetermined position.

In addition, the automatic loading operation may be an independent operation rather than a continuous operation from the automatic unloading operation. In this case, when the trigger 12A is not operated and the automatic loading and unloading switch 16*b* is operated, it is determined that an operation of performing the automatic loading operation is performed, and the automatic loading operation is performed by the processes from step SC8 described above.

In the automatic loading and unloading mode described in FIG. 8, when it is determined, by detecting that the feed motor 33 is rotated in the forward rotation direction without driving the control unit 14A, that the operation of inserting the wire W between the first feed gear 30L and the second feed gear 30R by the user of the reinforcing bar binding machine 1A is performed, the feed motor 33 is driven at the first rotation speed V1 in the forward rotation direction, which is the loading direction of the wire W, as the first state. The first rotation speed V1 is lower than the second rotation speed V2, which is a rotation speed for feeding the wire W in the forward direction in the binding operation described above or a rotation speed for feeding the tip of the wire W to the standby position.

When it is determined that the amount of rotation of the feed motor 33 at the first rotation speed V1 in the forward direction reaches the first defined amount of rotation for the loading operation, the feed motor 33 is driven at the second rotation speed V2 in the forward rotation direction, which is the loading direction of the wire W, as the second state.

Accordingly, a matter that by the operation of inserting the wire W between the first feed gear 30L and the second feed gear 30R by the user of the reinforcing bar binding machine 1A, the wire W is fed in the forward direction by driving the feed motor 33 can be recognized based on a fact of feeding the wire W in the forward direction by rotating the feed motor 33 in the forward direction at the first rotation speed V1.

In the automatic loading and unloading mode described above, when the operation of inserting the wire W between the first feed gear 30L and the second feed gear 30R by the user of the reinforcing bar binding machine 1A is performed, the second feed gear 30R is pushed by the wire W, and a force for moving the second feed gear 30R away from the first feed gear 30L is generated. As shown in FIG. 2B, when the operation button 39 is not operated, the second feed gear 30R can move by the gap G1 in a direction away from the first feed gear 30L without receiving the force of the spring 38.

Accordingly, by the operation of inserting the wire W between the first feed gear 30L and the second feed gear 30R by the user of the reinforcing bar binding machine 1A, the second feed gear 30R moves in a direction away from the first feed gear 30L, thereby forming the gap G2 between the first feed gear 30L and the second feed gear 30R, as shown in FIG. 2C. Therefore, since the interval between the groove portion 32L of the first feed gear 30L and the groove portion 32R of the second feed gear 30R facing each other is widened, it is easy to insert the wire W between the first feed gear 30L and the second feed gear 30R.

In the automatic loading and unloading mode described above, as described in step SA8 in FIG. 6, step SB8 in FIG. 7, and step SC8 in FIG. 8, the rotation of the feed motor 33 in the forward rotation direction is detected, and the automatic loading operation of the wire W is started. The feed motor 33 is rotated by inserting the wire W between the first feed gear 30L and the second feed gear 30R and rotating the first feed gear 30L.

However, in a configuration different from the configuration described in the present embodiment in which the gap G2 can be formed between the first feed gear 30L and the second feed gear 30R by forming the gap G1 between the pressing portion 37*b* of the second displacement member 37 and the pressed portion 36*b* of the first displacement member 36, it is necessary to move the second feed gear 30R away from the first feed gear 30L while compressing the spring 38 with a force for pushing the wire W in an extending direction. Accordingly, a high load is applied to the wire W, and problems in loading the wire W, such as the wire W buckling, may occur.

In contrast, by forming the gap G1 between the pressing portion 37*b* of the second displacement member 37 and the pressed portion 36*b* of the first displacement member 36, the second feed gear 30R can move in the direction away from the first feed gear 30L in a state in which the force of the spring 38 is not applied.

Accordingly, when a force for pushing the wire W in the extending direction is applied to the first feed gear 30L and the second feed gear 30R, in the state in which the force of the spring 38 is not applied, the first feed gear 30L rotates while the second feed gear 30R moves in the direction away from the first feed gear 30L. Therefore, the first feed gear 30L can be rotated while a high load is prevented from being applied to the wire W, and the load due to a pressure of the spring 38 in a case of loading the wire W is reduced, thereby facilitating the loading of the wire W for initiating the automatic loading operation of the automatic loading and unloading mode described above.

In addition, in the automatic loading operation described above, when the feed motor 33 is driven in the forward rotation direction by driving the control unit 14A, the wire W is fed in the forward direction between the first feed gear 30L and the second feed gear 30R by the driving force of the feed motor 33.

When the wire W is fed between the first feed gear 30L and the second feed gear 30R by the driving force of the feed motor 33, depending on a thickness of the wire W, the second feed gear 30R further moves in the direction indicated by the arrow U1 away from the first feed gear 30L. Therefore, the pressing portion 37*b* of the second displacement member 37 is pressed by the pressed portion 36*b* of the first displacement member 36, and the second displacement member 37 rotates in the direction indicated by the arrow Y1 with the shaft 37*a* as the fulcrum. In this way, the second displacement member 37 is separated from the operation button 39. Accordingly, a force that causes the spring 38 to expand is transmitted to the second feed gear 30R via the second displacement member 37 and the first displacement member 36, and the wire W is sandwiched between the first feed gear 30L and the second feed gear 30R. Therefore, the wire W is clamped between the first feed gear 30L and the second feed gear 30R by the force of the spring 38, and a sufficient frictional force is generated between the wire W and the first feed gear 30L and the second feed gear 30R, and thus, the wire W can be reliably fed by the driving force of the feed motor 33.

In addition, in the wire guide 4A, when the angle α1 of the leading unit 41A1 with respect to the reference path L is 0° or more and 17° or less, the extending direction of the wire W passing through the wire guide 4A approaches parallel to the reference path L. Accordingly, in the automatic loading and unloading mode described above, by the operation of inserting the wire W between the first feed gear 30L and the second feed gear 30R by the user of the reinforcing bar binding machine 1A, the success rate of the tip of the wire W passing through the wire guide 4A entering between the groove portion 32L of the first feed gear 30L and the groove portion 32R of the second feed gear 30R increases.

In addition, in the wire guide 4A, when the angle α1 of the leading unit 41A1 with respect to the reference path L is more than 0° and 9° or less, the success rate of the tip of the wire W entering between the groove portion 32L of the first feed gear 30L and the groove portion 32R of the second feed gear 30R increases while difficulty of inserting the wire W into the guide hole 40A from the lead-in side opening 40A2 is prevented from increasing.

The invention claimed is:

1. A binding machine, comprising:

a wire feeder configured to feed a wire in a first direction;

a curl guide unit forming a wire feeding path for winding, around objects to be bound, the wire fed in the first direction by the wire feeder, the curl guide unit being configured to impart a curl to the wire;

a binding unit including a wire locking body that locks the wire and a rotation shaft that rotatably supports the wire locking body, the binding unit configured to bind the wire by twisting, by rotating the rotation shaft, the wire wound around the objects to be bound with the curl guide unit; and a controller configured to control the wire feeder and the binding unit, wherein the wire feeder includes a pair of feed members configured to clamp the wire and feed the wire by a rotation operation, and a feed motor configured to drive the pair of feed members to feed the wire in the first direction, wherein the controller sets a state of the binding machine from a first state to a second state of feeding the wire in the first direction at a predetermined rotation speed, when the wire is inserted into a position where the wire is feedable in the first direction by the pair of feed members, thereby performing a loading operation, and wherein the first state is a state of feeding the wire in the first direction at a rotation speed lower than the predetermined rotation speed.

2. The binding machine according to claim 1, wherein the controller is configured to perform an unloading operation that, before performing the loading operation, rotates the feed motor in a second rotation direction opposite to a first rotation direction in which the feed motor rotates to drive the pair of feed members to feed the wire in the first direction, and feeds the wire clamped by the pair of feed members in a second direction to a position away from the pair of feed members.

3. The binding machine according to claim 1, further comprising:

a holding member configured to hold a state that secures an interval between the pair of feed members in a state in which no wire is inserted between the pair of feed members.

4. The binding machine according to claim 1, further comprising:

a wire guide including a leading guide unit that is disposed on an upstream side in the first direction with respect to the pair of feed members, and that leads the wire to be inserted between the pair of feed members.

5. A binding machine, comprising:

a wire feeder configured to feed a wire in a first direction;

a curl guide unit forming a wire feeding path for winding, around objects to be bound, the wire fed in the first direction by the wire feeder, the curl guide unit being configured to impart a curl to the wire;

a binding unit including a wire locking body that locks the wire and a rotation shaft that rotatably supports the wire locking body, the binding unit configured to bind the wire by twisting, by rotating the rotation shaft, the wire wound around the objects to be bound with the curl guide unit;

a notification unit including at least one of a buzzer, a lamp, and a display; and a controller configured to control the wire feeder and the binding unit, wherein the wire feeder includes a pair of feed members configured to clamp the wire and feed the wire by a rotation operation, and a feed motor configured to drive the pair of feed members to feed the wire in the first direction, wherein the controller sets a state of the binding machine from a first state to a second state of feeding the wire in the first direction at a predetermined rotation speed, when the wire is inserted into a position where the wire is feedable in the first direction by the pair of feed members, thereby performing a loading operation, and wherein the first state is a state of performing notification by the notification unit.

6. The binding machine according to claim 5, wherein the controller is configured to perform an unloading operation that, before performing the loading operation, rotates the feed motor in a second rotation direction opposite to a first rotation direction in which the feed motor rotates to drive the pair of feed members to feed the wire in the first direction, and feeds the wire clamped by the pair of feed members in a second direction to a position away from the pair of feed members.

7. The binding machine according to claim 5, further comprising:

a holding member configured to hold a state that secures an interval between the pair of feed members in a state in which no wire is inserted between the pair of feed members.

8. The binding machine according to claim 5, further comprising:

a wire guide including a leading guide unit that is disposed on an upstream side in the first direction with respect to the pair of feed members, and that leads the wire to be inserted between the pair of feed members.

9. A binding machine, a wire feeder configured to feed a wire in a first direction;

a curl guide unit forming a wire feeding path for winding, around objects to be bound, the wire fed in the first direction by the wire feeder, the curl guide unit being configured to impart a curl to the wire;

a binding unit including a wire locking body that locks the wire and a rotation shaft that rotatably supports the wire locking body, the binding unit configured to bind the wire by twisting, by rotating the rotation shaft, the wire wound around the objects to be bound with the curl guide unit; and a controller configured to control the wire feeder and the binding unit, wherein the wire feeder includes a pair of feed members configured to clamp the wire and feed the wire by a rotation operation, and a feed motor configured to drive the pair of feed members to feed the wire in the first direction, wherein the binding machine further comprises a rotation detector configured to detect that the feed motor is rotated in the first direction in a state where the feed motor is not rotating by energization, wherein the controller sets a state of the binding machine from a first state to a second state of feeding the wire in the first direction at a predetermined rotation speed, when the wire is inserted into a position where the wire is feedable in the first direction by the pair of feed members, thereby performing a loading operation, and wherein the controller is configured to detect, by the rotation detector, the wire is inserted into a position where the wire is feedable in the first direction by the pair of feed members.

10. The binding machine according to claim 9, wherein the controller is configured to perform an unloading operation that, before performing the loading operation, rotates the feed motor in a second rotation direction opposite to a first rotation direction in which the feed motor rotates to drive the pair of feed members to feed the wire in the first direction, and feeds the wire clamped by the pair of feed members in a second direction to a position away from the pair of feed members.

11. The binding machine according to claim 9, further comprising:

a holding member configured to hold a state that secures an interval between the pair of feed members in a state in which no wire is inserted between the pair of feed members.

12. The binding machine according to claim 9, further comprising:

a wire guide including a leading guide unit that is disposed on an upstream side in the first direction with respect to the pair of feed members, and that leads the wire to be inserted between the pair of feed members.

13. The binding machine according to claim 9, wherein the first state is state of not rotating the feed motor.

* * * * *